US005442277A

United States Patent [19]

Mori et al.

[11] Patent Number: 5,442,277

[45] Date of Patent: Aug. 15, 1995

[54] INTERNAL POWER SUPPLY CIRCUIT FOR GENERATING INTERNAL POWER SUPPLY POTENTIAL BY LOWERING EXTERNAL POWER SUPPLY POTENTIAL

[75] Inventors: Shigeru Mori; Takeshi Kajimoto, both of Hyogo, Japan

[73] Assignee: Mitsubishi Denki Kabushiki Kaisha, Tokyo, Japan

[21] Appl. No.: 196,730

[22] Filed: Feb. 15, 1994

[30] Foreign Application Priority Data

Feb. 15, 1993 [JP] Japan ..... 5-025207
Dec. 7, 1993 [JP] Japan ..... 5-306517

[51] Int. Cl.[6] ..... G05F 3/04
[52] U.S. Cl. ..... 323/312; 327/530
[58] Field of Search ..... 323/312, 313, 314; 307/296.1, 296.4, 296.6; 365/226, 227, 228, 229

[56] References Cited

U.S. PATENT DOCUMENTS

| | | | |
|---|---|---|---|
| 5,184,031 | 2/1993 | Hayakawa et al. | 307/296.1 |
| 5,194,762 | 3/1993 | Hara et al. | 307/296.8 |
| 5,197,033 | 3/1993 | Watanabe et al. | 365/226 |
| 5,249,155 | 9/1993 | Arimoto et al. | 365/222 |
| 5,309,044 | 5/1994 | Wang | 323/312 |
| 5,315,166 | 5/1994 | Arimoto | 307/296.1 |

FOREIGN PATENT DOCUMENTS

| | | | |
|---|---|---|---|
| 3-194797 | 8/1991 | Japan | G11C 29/00 |
| 4-64989 | 2/1992 | Japan | G11C 11/409 |

OTHER PUBLICATIONS

"Nikkei Micro Device", Feb. 1990, pp. 115–122.

*Primary Examiner*—Thomas M. Dougherty
*Assistant Examiner*—Matthew V. Nguyen
*Attorney, Agent, or Firm*—Lowe, Price, LeBlanc & Becker

[57] ABSTRACT

An internal power supply circuit includes a main internal power supply potential generating circuit for generating an internal power supply potential based on a prescribed reference potential, and an auxiliary internal power supply potential generating circuit which is activated in response to a control signal and when activated, generating an internal power supply potential together with the main internal power supply potential generating circuit. The auxiliary internal power supply potential generating circuit includes a P channel MOS transistor for driving, a differential amplifying circuit for controlling the driving transistor by comparing the internal power supply potential with the reference potential and a standby potential supplying circuit for applying a standby potential which is slightly higher than the threshold potential at the which the transistor is rendered conductive, to the gate of the driving transistor while the differential amplifying circuit is not activated. In the internal power supply circuit, since a standby potential which is slightly higher than the threshold potential is applied to the gate of the driving transistor at the standby state, charges are immediately supplied to an output node when the auxiliary internal power supply potential generating circuit is activated.

16 Claims, 15 Drawing Sheets

FIG.4(a) ext/RAS
FIG.4(b) φ1
FIG.4(c) φ4
|Vtp1|
extVcc
|Vtp|
FIG.4(d) CURRENT CONSUMPTION IN INTERNAL CIRCUITRY
0
FIG.4(e) intVcc
3V
t0
t1
t2
t3
t4

INT. CKT
intVcc
extVcc
Vtp
Vtp1
Vtp2
Vref
REFERENCE POTENTIAL GENERATING CKT
AMPLITUDE CONVERTING CKT
DELAY CKT
/RAS BUFFER
ext/RAS
φ4
φ2
φ5
1
10
11
20
30A
40
44
50
65
70
301
302
303
401
402
403
404
405
406
407
408
421
422
424
425
426
427
428
429
441
442
443
701
702
703
704
705

FIG.9(a) A0~An
FIG.9(b) ATD
FIG.9(c) φ6
FIG.9(d) DELAY φ6
|Vtp1|
extVcc
|Vtp|
FIG.9(e) φ4
FIG.9(f) CURRENT CONSUMPTION IN INTERNAL CIRCUITRY
0
FIG.9(g) intVcc
3V
t0 t1 t2 t3 t4 t5

FIG. 11(a) ext/RAS
FIG. 11(b) φ1
FIG. 11(c) φ7
|Vtp3|
extVcc
|Vtp|
FIG. 11(d) φ8
|Vtp3|
extVcc
FIG. 11(e) CURRENT CONSUMPTION IN INTERNAL CIRCUITRY
0
FIG. 11(f) intVcc
3V
t0
t1
t2
t3
t4

FIG. 13(a) ext/RAS
FIG. 13(b) φ1
FIG. 13(c) φ9
|Vtp3|
extVcc
|Vtp|
FIG. 13(d) CURRENT CONSUMPTION IN INTERNAL CIRCUITRY
0
FIG. 13(e) intVcc
3V
t0
t1
t2
t3
t4

FIG. 15(a) ext/RAS
FIG. 15(b) φ1
extVcc
|Vtp|
FIG. 15(c) φ10
FIG. 15(d) CURRENT CONSUMPTION IN INTERNAL CIRCUITRY
0
FIG. 15(e) intVcc
3V
t0
t1
t2
t3
t4

FIG. 18 PRIOR ART
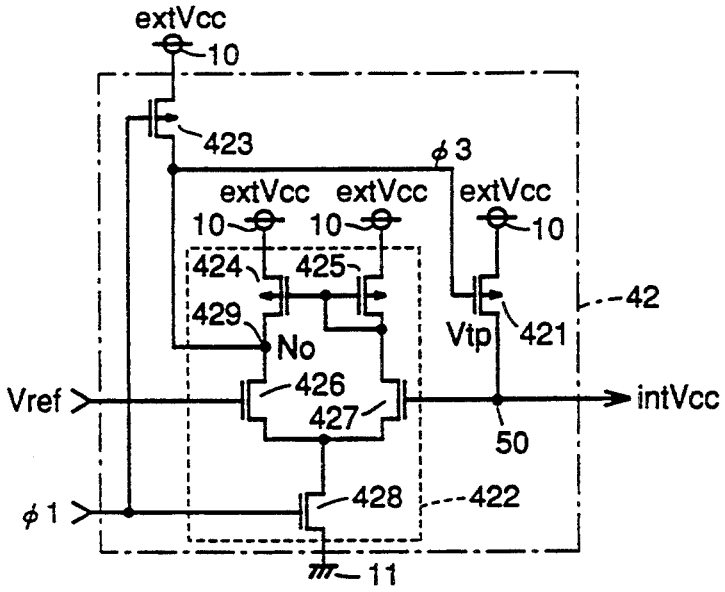
FIG. 19(a) ext/RAS
PRIOR ART
FIG. 19(b) φ1
PRIOR ART
FIG. 19(c) No
PRIOR ART
FIG. 19(d) CURRENT CONSUMPTION IN INTERNAL CIRCUITRY
PRIOR ART
FIG. 19(e) intVcc
PRIOR ART
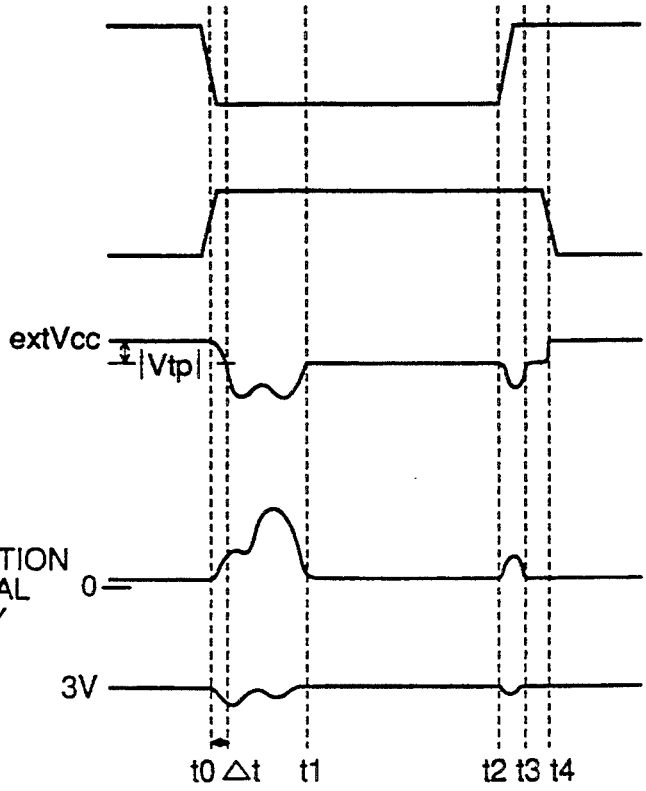

INTERNAL POWER SUPPLY CIRCUIT FOR GENERATING INTERNAL POWER SUPPLY POTENTIAL BY LOWERING EXTERNAL POWER SUPPLY POTENTIAL

CROSS-REFERENCE TO RELATED APPLICATION

This application is related to application Ser. No. 08/135,650, filed Oct. 14, 1993, commonly assigned with the present invention.

BACKGROUND OF THE INVENTION

1. Field of the Invention

The present invention relates to an internal power supply circuit and, more specifically, to an internal power supply circuit lowering an externally applied external power supply potential to a lower internal power supply potential and supplying the same to an internal circuitry of a semiconductor integrated circuit.

2. Description of the Background Art

Breakdown voltage of a transistor used in a semiconductor integrated circuit has been lowered as the device has been miniaturized. Accordingly, supply potential must be lowered. However, since the same power supply as that for ICs such as TTL (Transistor Transistor Logic) is used, the externally applied external power supply potential is maintained as it is, and an internal power supply potential is supplied to internal circuitry of the semiconductor integrated circuit by lowering the external power supply potential by using an internal power supply circuit provided on the chip.

FIG. 16 is a block diagram showing a structure of a DRAM (Dynamic Random Access Memory) including such a conventional internal power supply circuit.

Referring to FIG. 16, the DRAM includes an internal circuitry 1 including a memory cell array, sense amplifiers and address decoders, and an internal power supply circuit for supplying an internal power supply potential intVcc to the internal circuitry 1.

The internal power supply circuit includes a reference potential generating circuit 20, a control circuit 30, a main internal power supply potential generating circuit 40, an auxiliary internal power supply potential generating circuit 42, and an output node 50.

Reference potential generating circuit 20 is connected between an external power supply node 10 to which an external power supply potential extVcc (of, for example, 5 V) is applied and a ground node 11, and generates a constant reference potential Vref (of, for example, 3 V) based on the external power supply potential extVcc.

Main internal power supply potential generating circuit 40 is connected between external power supply node 10 and the ground node 11, and constantly generates at output node 50, an internal power supply potential intVcc (of, for example, 3 V) referring to the reference potential Vref from reference potential generating circuit 20.

Control circuit 30 generates a control signal $\phi 1$ in response to an external row address strobe signal ext/RAS. Internal circuitry 1 operates in response to an external row address strobe signal ext/RAS.

Auxiliary internal power supply potential generating circuit 42 is activated in response to control signal $\phi 1$ from control circuit 30, and when activated, generates an internal power supply potential intVcc at output node 50, referring to reference potential Vref.

Main internal power supply potential generating circuit 40 has small current supplying capability. However, it always operates with small power consumption, and supplies a small amount of current which is constantly consumed by internal circuitry 1. Meanwhile, auxiliary internal power supply potential generating circuit 42 consumes much power. However, its current supplying capability is larger than that of the main internal power supply potential generating circuit 40. Auxiliary internal power supply potential generating circuit 42 does not operate in the normal state (standby state) and operates only when internal circuitry 1 operates to consume a large amount of current.

Accordingly, current consumption at the standby state, when internal circuit 1 is not operating, is very small, and necessary current is supplied only when internal circuitry 1 operates. Thus, the internal power supply circuit as a whole does not match consume power.

The structure and operation of the internal power supply circuit has been briefly described. Details will be given in the following.

FIG. 17 is a schematic diagram showing a structure of main internal power supply potential generating circuit 40 shown in FIG. 16. This main internal power supply potential generating circuit 40 is a generally known one which is disclosed, for example, in page 117 of Nikkei Micro Device, February, 1990.

Referring to FIG. 17, main internal power supply potential generating circuit 40 includes a P channel MOS transistor 401 connected between external power supply node 10 and output node 50, and a current mirror type differential amplifier circuit 402.

Differential amplifier circuit 402 compares internal power supply potential intVcc generated at output node 50 with reference potential Vref, and applies a control signal $\phi 2$ to the gate of P channel MOS transistor 401, which signal attains approximately to the ground potential when internal power supply potential intVcc is lower than reference potential Vref and which attains approximately to the external power supply potential extVcc when internal power supply potential intVcc is higher than the reference potential Vref.

Differential amplifier circuit 402 includes two P channel MOS transistors 403 and 404 constituting a current mirror, an N channel MOS transistor 405 having a gate receiving the reference potential Vref, an N channel MOS transistor 406 having a gate receiving internal power supply potential intVcc, and an N channel MOS transistor 407 having a gate receiving external power supply potential extVcc.

P channel MOS transistor 403 is connected between external power supply node 10 and output node 408. P channel MOS transistor 404 is connected to the gate of transistor 403, and has its gate and drain connected to each other and its source connected to external power supply node 10.

N channel MOS transistor 405 is connected in series with transistor 403. N channel MOS transistor 406 is connected in series with transistor 403. N channel MOS transistor 407 has its drain connected to the sources of transistors 405 and 406, and its source connected to the ground node 11. Since transistor 407 is constantly supplied with the external power supply potential extVcc at its gate, a constant current always flows between its source and drain.

What the main internal power supply potential generating circuit 40 has to do is to supply current (of, for example, several ten mA) consumed in internal circuitry 1 in the standby state. Therefore, the size of the P channel MOS transistor 401 for driving is minimized. In other words, the ratio of its channel width with respect to the channel length is minimized.

Similarly, the size of N channel MOS transistor 407 which is constantly conductive is made small. Consequently, through current flowing from external power supply node 10 through transistors 403, 405 and 407 to the ground node 11 as well, as the through current flowing from external power supply node 10 through transistors 404,406 and 407 to the ground node are reduced, whereby power consumption of differential amplifying circuit 402 is reduced.

FIG. 18 is a schematic diagram showing the structure of auxiliary internal power supply potential generating circuit 42 shown in FIG. 16.

Referring to FIG. 18, auxiliary internal power supply potential generating circuit 42 includes a P channel MOS transistor 421 connected between external power supply node 10 and output node 50, a current mirror type differential amplifying circuit 422 comparing internal power supply potential intVcc with reference potential Vref for controlling transistor 421, and a P channel MOS transistor 423 connected between external power supply node 10 and the gate of transistor 421.

Similarly to the above described differential amplifying circuit 402, differential amplifying circuit 422 includes two P channel MOS transistors 424 and 425 constituting a current mirror, and three N channel MOS transistors 426 to 428.

Auxiliary internal supply potential generating circuit 42 differs from the above described main internal supply potential generating circuit 40 in the following points. First, the size of driving transistor 421 is made larger than that of driving transistor 401 so that it has larger current driving capability.

Second, control signal $\phi$1 from control circuit 30 is applied to the gate electrode of transistor 428 in differential amplifying circuit 422, transistor 428 is rendered conductive in response to control signal $\phi$1, and the size of transistor 428 is made larger than that of transistor 407.

Third, a transistor 423 is provided. Transistor 423 receives at its gate the control signal $\phi$1 from control circuit 30. Therefore, transistor 423 is rendered conductive when transistor 428 is non-conductive, while it is rendered non-conductive when transistor 428 is conductive.

Since control signal $\phi$1 attains to the H level only when internal circuitry 1 operates, differential amplifying circuit 422 is inactivated in the standby state in which internal circuitry 1 is not operative, and transistor 421 is rendered non-conductive since external supply potential extVcc is applied to its gate.

When internal circuitry 1 operates, control signal $\phi$1 attains to the H level, differential amplifying circuit 422 is activated and transistor 423 is rendered non-conductive, so that auxiliary internal power supply potential generating circuit 42 as a whole is activated.

The operation of the internal power supply circuit will be discussed in greater detail.

First, the operation when control signal 61 output from control circuit 30 is at L level will be described.

Reference potential generating circuit 20 receives external power supply potential extVcc from external power supply node 10 and generates a reference potential Vref.

Differential amplifying circuit 402 in main internal power supply potential generating circuit 40 receives the reference potential Vref and internal power supply potential intVcc from output node 50, and when internal power supply potential intVcc is lower than reference potential Vref, provides a control signal $\phi$2 which is approximately at the ground potential through output node 408.

Control signal $\phi$2 is applied to the gate of driving transistor 401, so that transistor 401 is rendered conductive. Consequently, charges are supplied from external power supply node 10 to output node 50 through transistor 401, so that potential intVcc of output node 50 increases.

Meanwhile, when internal power supply potential intVcc is higher than reference potential Vref, differential amplifying circuit 402 in main internal power supply potential generating circuit 40 provides a control signal $\phi$2 which is approximately at the external power supply potential extVcc through output node 408. Consequently, driving transistor 401 is rendered non-conductive.

In this manner, when current is consumed in internal circuitry 1 and internal power supply potential intVcc becomes lower than reference potential Vref, main internal power supply potential generating circuit 40 supplies charges from external power supply node 10 to output node 50, and when internal power supply potential intVcc becomes higher than reference potential Vref, stops supply of the charges.

In auxiliary internal power supply potential generating circuit 42, when control signal $\phi$1 at the L level is applied to the gate of transistor 428 of differential amplifying circuit 422, the transistor 428 is rendered non-conductive. Therefore, differential amplifying circuit 422 does not operate.

At this time, in differential amplifying circuit 422, potentials at gates of transistors 424 and 425 are increased to a potential (for example, 4 V) lower than the external power supply potential (for example, 5 V) by an absolute value (for example, 1 V) of the threshold voltage (for example, −1 V) of transistors 424 and 425, and transistors 424 and 425 are rendered non-conductive.

Accordingly, the potential No at output node 429 attains to a potential (for example, 2 V) lower than the reference potential Vref (for example, 3 V) applied to the gate of transistor 426 by the threshold voltage (for example, 1 V) of the transistor 426, so that transistor 426 is rendered non-conductive. At this time, the differential amplifying circuit 422 is at a stable state.

In such a stable state, potential No at output node 429 is applied to the gate of driving transistor 421, and therefore it may be rendered conductive at any time. Therefore, there is a possibility that external power supply node 10 and output node 50 are conducted, causing internal power supply potential intVcc to be the external power supply potential extVcc.

In order to prevent such event, P channel MOS transistor 423 is provided, which receives at its gate the control signal $\phi$1. When control signal $\phi$1 at the L level supplied to the gate of transistor 423, transistor 423 is rendered conductive, so that external power supply potential extVcc is applied to the gate of driving transistor 421.

In this manner, in auxiliary internal power supply potential generating circuit 42, its driving transistor is adapted to be non-conductive in the standby state. The operation when control signal $\phi$1 from control circuit 30 is at H level will be described.

Main internal power supply potential generating circuit 40 operates in the same manner as described above, regardless of the state of control signal $\phi$1. Auxiliary internal power supply potential generating circuit 42 operates in the same manner as main internal power supply potential generating circuit 40, as N channel MOS transistor 428 is rendered conductive and P channel MOS transistor 423 is non-conductive.

The operation of the internal power supply circuit will be described with reference to the timing chart of FIG. 19.

Referring to FIG. 19(*a*), before time t0, when external row address strobe signal ext/RAS is at H level, in other words, in the standby state, control circuit 30 provides a control signal $\phi$1 at the L level as shown in FIG. 19(*b*) in response to the row address strobe signal ext/RAS of the H level.

At this time, as described above, auxiliary internal power supply potential generating circuit 42 does not operate, and only the main internal power supply potential generating circuit 40 operates. Therefore, the potential No at output node 429 of auxiliary internal power supply potential generating circuit 42 is set to the external power supply potential extVcc by means of P channel MOS transistor 423, as shown in FIG. 19(*c*).

Thereafter, referring to FIG. 19(*a*), at time t0, when row address strobe signal ext/RAS falls to the L level, internal circuitry 1 starts its operation. Accordingly, current of about 100 mA in average and several hundred mA at most is consumed, as shown in FIG. 19(*d*), and internal power supply potential intVcc lowers a little as shown in FIG. 19(*e*).

In response to the row address strobe signal ext/RAS at the L level, control circuit 30 provides a control signal $\phi$1 at the H level, as shown in FIG. 19(*b*). Consequently, transistor 428 in auxiliary internal power supply potential generating circuit 42 is rendered conductive, and transistor 423 is rendered non-conductive. Consequently, Potential No at output node 429 gradually lowers as shown in FIG. 19(*c*), and after the lapse of time At from time t0, it attains to a potential lower than external power supply potential extVcc by the absolute value |Vtp| of the threshold voltage of driving transistor 421.

Consequently, driving transistor 421 is rendered conductive, charges are supplied to the output node 50, and therefore internal power supply potential intVcc increases as shown in FIG. 19(*e*).

At time t1, when operation of internal circuitry 1 ends and current consumption is reduced, internal power supply potential intVcc increases. Accordingly, potential No at output node 429 of differential amplifying circuit 422 increases to a potential lower than the external power supply potential extVcc by the absolute value |Vtp| of the threshold voltage of P channel MOS transistor 421, as shown in FIG. 19(*c*). Consequently, driving transistor 421 is rendered non-conductive, and supply of charges to output node 50 is stopped.

Then, at time t2, when row address strobe signal ext/RAS attains to the H level, reset current flows in internal circuitry 1 from time t2 to t3, as shown in FIG. 19(*d*).

Taking into account the reset current, control signal $\phi$1 output from control circuit 30 falls to the L level at time t4 after a prescribed time period from time t2 at which row address strobe signal ext/RAS rises to H level, as shown in FIG. 19(*b*).

In the above described conventional internal power supply circuit, when control signal $\phi$1 from control circuit 30 rises from L level to H level at time t0 as shown in FIG. 19(*b*), the potential No at output node 429 of differential amplifying circuit 422, or the potential at the gate of driving transistor 421 begins to lower as shown in FIG. 19(*c*), and it further lowers to a potential extVcc—|Vtp| which is lower than the external power supply potential by the absolute value of the threshold voltage of driving transistor 421, and at this time, transistor 421 is rendered conductive for the first time so that charges are supplied from external power supply node 10 to output node 50.

Now, the channel width of transistor 421 is made large so as to increase current driving capability. Therefore, it has large gate capacitance and it takes time At as shown in FIG. 19(*c*) for the potential No of output node 429 to attain to sufficiently low potential as to render transistor 421 conductive.

On the other hand, internal circuitry 1 starts its operation, and therefore current consumption increases. Accordingly, internal power supply potential intVcc decreases from a prescribed potential (for example from 3 V to 2 V) during the time $\Delta t$ until the auxiliary internal power supply potential generating circuit starts supply of charges to output node 50, which leads to possible malfunction of internal circuitry 1.

In Japanese Patent Laying-Open No. 3-194797, a semiconductor memory device is disclosed in which base potential of an NPN transistor is set high in advance in a reference potential generating circuit for determining whether or not a redundancy circuit is to be used, allowing quick rise of word lines when the redundancy circuit is used.

Japanese Patent Laying-Open No. 4-64989 discloses a semiconductor memory device including a current mirror circuit for amplifying a signal read on a data bus in which, to the gate of transistors constituting the current mirror, a voltage smaller than the threshold voltage thereof is applied, so that the current mirror circuit can be activated quickly.

By contrast, the present invention relates to an improvement of an internal power supply circuit in which internal power supply potential is provided by lowering an external power supply potential.

SUMMARY OF THE INVENTION

An object of the present invention is to provide an internal power supply circuitry including an auxiliary internal power supply potential generating circuit which is immediately activated in response to a control signal.

Another object of the present invention is to provide an internal power supply potential generating circuit in which it is not necessary to force a driving transistor to a non-conductive state by increasing the gate potential of the transistor when a differential amplifying circuit of an auxiliary internal power supply potential generating circuit is activated.

A further object of the present invention is to provide an internal power supply potential generating circuit which consumes less current in the standby state.

Briefly stated, the internal power supply circuit for generating an internal power supply potential by lowering an external power supply potential in accordance with the present invention includes an output node, a main internal power supply potential generating circuit and an auxiliary internal power supply potential generating circuit.

Main internal power supply potential generating circuit generates an internal power supply potential constantly at an output node, based on a prescribed reference potential.

Auxiliary internal power supply potential generating circuit includes a switching element, a comparing circuit and a standby circuit.

Switching element is connected between an external power supply node to which the external power supply potential is applied and the output node, and when a voltage larger than a prescribed threshold voltage is applied, it conducts the external power supply node and the output node.

The comparing circuit is activated in response to a prescribed control signal and, when activated, compares a feedback potential which varies in response to the internal power supply potential generated at the output node with the reference potential, applies a control voltage larger than the threshold voltage to the switching element in a first case in which the feedback potential is lower than the reference potential, and applies a control voltage smaller than the threshold voltage to the switching element in a second case in which feedback potential is higher than the reference potential.

The standby circuit provides a standby voltage which is smaller than the threshold voltage but larger than zero volt to the switching element while the comparing circuit is not activated.

Therefore, a main advantage of the present invention is that a standby voltage which is slightly smaller than the threshold voltage of the switching element is applied to the switching element while the comparing circuit in the auxiliary internal power supply potential generating circuit is inactive, current is supplied from the external power supply node to the output node by the switching element immediately in response to the activation of the comparing circuit, so that variation of internal power supply potential can be reduced.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 18 is a schematic diagram showing the auxiliary internal power supply potential generating circuit in the internal power supply circuit shown in FIG. 16.

FIG. 19 is a timing chart showing the operation of the internal power supply circuit shown in FIG. 16.

DESCRIPTION OF THE PREFERRED EMBODIMENTS

Embodiments of the present invention will be described in detail with reference to the figures.

[Embodiment 1]

Figure 1:
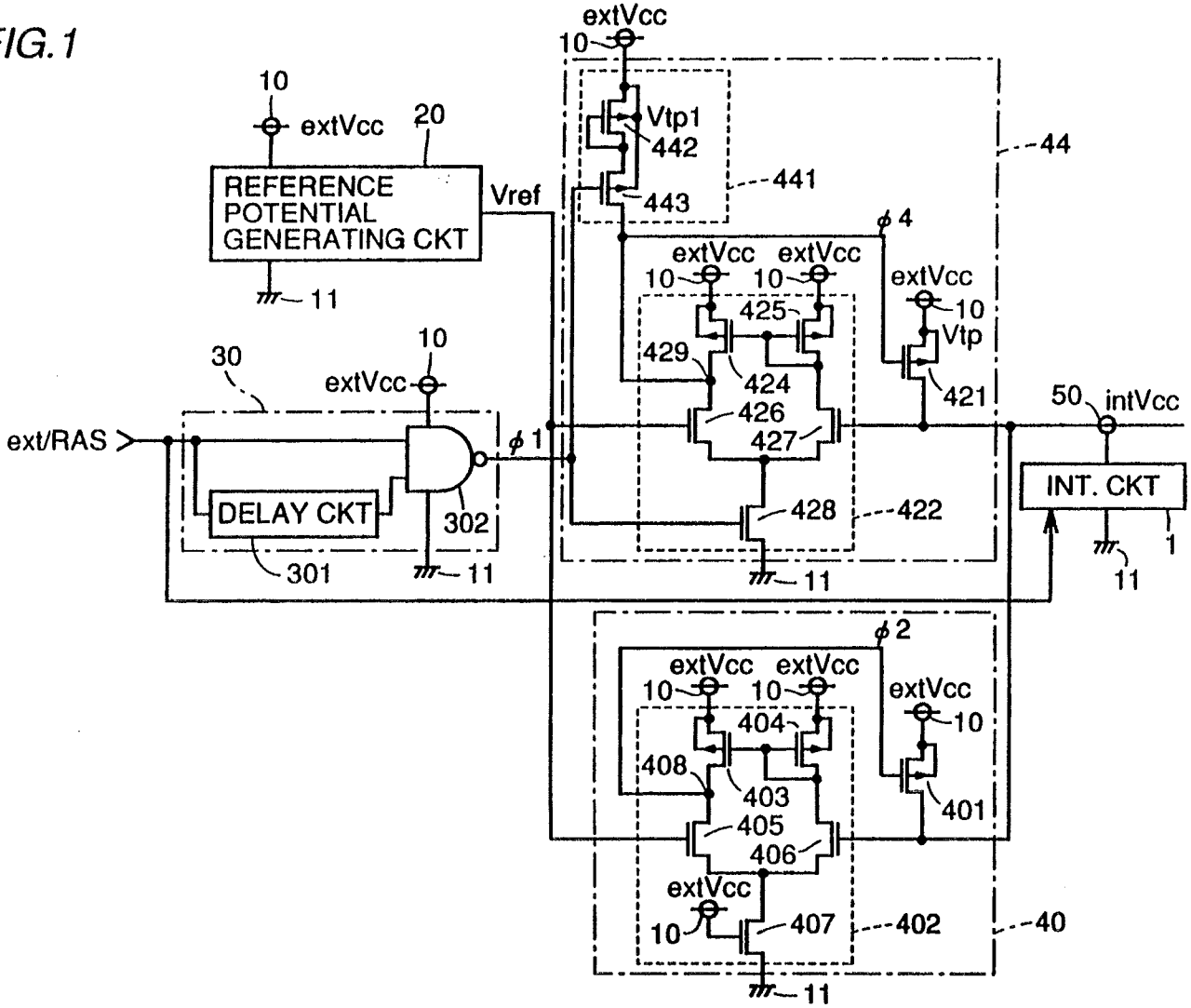
FIG. 1 is a block diagram showing a structure of a DRAM including the internal power supply circuit in accordance with the first embodiment of the present invention.

FIG. 1 is a block diagram showing the structure of the DRAM including the internal power supply circuit in accordance with the first embodiment of the present invention.

Referring to FIG. 1, the DRAM includes an internal power supply circuit which lowers an external power supply potential extVcc for generating an internal power supply potential intVcc, and an internal circuitry 1 including a memory cell array, sense amplifiers, address decoders and the like, operating based on the internal power supply potential intVcc.

The internal power supply circuit includes a reference potential generating circuit 20, a control circuit 30, a main internal power supply potential generating circuit 40 and an auxiliary internal power supply potential generating circuit 44.

Reference potential generating circuit 20 is connected between an external power supply node 10 to which an external power supply potential extVcc (of, for example 5 V) is applied, and a ground node 11 to which the circuit 40 includes a P channel MOS transistor 401 connected between external power supply node 10 and output node 50, and a differential amplifying circuit 402 which compares the internal power supply potential intVcc generated at output node 50 and the reference potential Vref supplied from reference potential generating circuit 20 for controlling the P channel MOS transistor 401.

Differential amplifying circuit 402 includes two P channel MOS transistors 403 and 404 constituting a current mirror circuit, and three N channel MOS transistors 405 to 407.

P channel MOS transistor 403 has its source connected to the external power supply node 10, its drain connected to the output node 408, and its gate connected to the gate and drain of P channel MOS transistor 404. In this P channel MOS transistor 403, the backgate and the source are commonly connected.

P channel MOS transistor 404 has its source connected to the external power supply node 10.

N channel MOS transistor 405 has its drain connected to the drain of transistor 403 and to output node 408. N channel MOS transistor 406 has its drain connected to the gate and drain of transistor 404, and its source connected to the source of transistor 405.

N channel MOS transistor 407 has its drain connected ground potential (for example, 0 V) is applied, and generates a constant reference potential Vref (of, for example, 3 V) which is lower than the external power supply potential extVcc and independent from the fluctuation of external power supply potential extVcc.

Control circuit 30 outputs a control signal $\phi$1 in response to an external row address strobe signal ext/RAS. Control signal $\phi$1 is approximately synchronized with an inverted signal of the row address strobe signal ext/RAS. Control signal $\phi$1 has an H level which is approximately at the external power supply potential extVcc and a L level which is approximately at the ground potential. In other words, control signal $\phi$1 has two levels.

Control circuits 30 includes a delay circuit 301 constituted by even-numbered inverters connected in series, and an AND gate 302, for example.

Delay circuit 301 responds to and delays the external row address strobe signal ext/RAS so as to provide the delayed signal. NAND gate 302 provides a control signal $\phi$1 in response to the external row address strobe signal ext/RAS and to the delayed signal from delay circuit 301, which control signal attains to the L level when these two signals are both at H level and attains to the H level when at least one of these signals is at the L level.

Main internal power supply potential generating to the sources of transistors 405 and 406, its drain connected to the ground node 11, and its gate connected to the external power supply node 10. Therefore, transistor 407 serves as a constant current source supplying a constant current to transistors 403 and 405 as well as to transistors 404 and 406.

The size of transistor 407 is set such that a current consumed by the internal circuitry 1 in the standby state ($\phi$1=L) can be supplied. In other words, in order to reduce extra current consumption as much as possible, the ratio of the channel width with respect to the channel length is made relatively small.

The differential amplifying circuit 402 provides, when the internal power supply potential intVcc applied to the gate of transistor 406 is lower than the reference potential Vref applied to the gate of transistor 405, a control potential $\phi$2 lower than a prescribed potential to the gate of transistor 401 through output node 408. Differential amplifying circuit 402 provides, when the internal power supply potential intVcc applied to the gate of transistor 406 is higher than the reference potential Vref applied to the gate of transistor 405, a control potential $\phi$2 higher than the prescribed potential to the gate of transistor 401 through output node 408. The prescribed potential means a potential lower than the external power supply potential extVcc by the absolute value of the threshold voltage of transistor 401.

Therefore, when the control potential $\phi$2 which is higher than the prescribed potential is applied to the gate of transistor 401, transistor 401 is rendered nonconductive, and when the control potential $\phi$2 lower than the prescribed potential is applied to the gate of transistor 401, the transistor 401 is rendered conductive.

The size of the transistor 401 is set such that the current consumed by the internal current circuitry 1 in the standby state ($\phi$1=L) can be supplied, as is the transistor 407 mentioned above. In other words, the ratio of the channel width with respect to its channel length is made small.

Auxiliary internal power supply potential generating circuit 44 includes a P channel MOS transistor 421 connected between external power supply node 10 and output node 50, a differential amplifying circuit 422 comparing an internal power supply potential intVcc generated at output node 50 with a reference potential Vref supplied from the reference potential generating circuit for controlling the transistor 421, and a standby potential supplying circuit 441 for supplying a prescribed standby potential to the gate of transistor 421.

Differential amplifying circuit 422 includes two P channel MOS transistors 424 and 425 constituting a current mirror, and three N channel MOS transistors 426 to 428.

Transistor 424 has its source connected to the external power supply node 10 and its drain connected to output node 429. In transistor 424, its source and backgate are commonly connected. Transistor 425 has its source connected to external power supply node 10, and its gate and drain connected to the gate of transistor 424. In transistor 425, its source and the backgate are commonly connected.

Transistor 426 has its drain connected to output node 429 and a reference potential Vref is applied to its gate. Transistor 427 has its drain connected to the drain and gate of transistor 425, the internal power supply potential intVcc is feedback to its gate, and its source is connected to the source of transistor 426. Transistor 428 has its drain connected to the sources of transistors 426 and 427, its source connected to the ground node 11, and its gate connected to receive control signal $\phi$1 from control circuit 30.

Transistor 428 is rendered conductive when the control signal $\phi$1 at H level is applied to its gate. Transistor 428 has a relatively large size. In other words, the ratio of channel width with respect to the channel length is relatively large.

Therefore, when transistor 428 is rendered conductive, a large amount of current flows to transistors 424 and 426 as well as to transistors 425 and 427, whereby the amplification ratio of differential amplifying circuit 422 is increased.

Differential amplifying circuit 422 is activated while the control signal $\phi$1 is at the H level. Differential amplifying circuit 422 further compares the internal supply potential intvcc with the reference potential Vref, and when the internal power supply potential intVcc is lower than the reference potential Vref, applies a control potential $\phi$4 which is lower than a prescribed potential to the gate of transistor 421 through output node 429. When the internal power supply potential intVcc is higher than the reference potential Vref, the differential amplifying circuit 422 applies the control potential $\phi$4 which is higher than the prescribed potential to the gate of transistor 421 through output node 429. The prescribed potential here means a potential lower than the external power supply potential extVcc by the absolute value |Vtp| of the threshold voltage of the transistor 421.

Accordingly, when the control potential $\phi$4 higher than the prescribed potential is applied to the gate of transistor 421, the transistor 421 is rendered non-conductive, and when the control potential $\phi$4 lower than the prescribed potential is applied, it is rendered conductive.

Standby potential supplying circuit 441 includes two P channel MOS transistors 442 and 443 connected in series between external power supply node 10 and the gate of transistor 421.

Transistor 442 is diode connected, and the absolute value of its threshold voltage |Vtp1| (for example, 0.9 V) is smaller than the absolute value |Vtp| (for example, 1.0 V) of the threshold voltage of transistor 421. In transistor 442, its source and its backgate are commonly connected.

Control signal $\phi$1 is applied to the gate of transistor 443, when control signal $\phi$1 is at H level, transistor 443 is rendered non-conductive, and when control signal $\phi$1 is at the L level, transistor 443 is rendered conductive. Transistor 443 has its backgate connected to external power supply node 10.

Therefore, when control signal $\phi$1 is at the L level, that is, when differential amplifying circuit 422 is not activated, standby potential supplying circuit 441 provides a standby potential extVcc—|Vtp1| which is lower than the external power supply potential by the absolute value of the threshold voltage of transistor 442, to the gate of transistor 421. The standby potential is higher than a potential extVcc—|Vtp| which is lower than the external power supply potential by the absolute value of the threshold voltage of transistor 421, and lower than the external power supply potential extVcc. More specifically, in the standby state, between the source and the gate of transistor 421, a voltage larger than 0 volt but smaller than the absolute value |Vtp| of the threshold voltage of the transistor is applied.

Structures of transistors 421 and 442 will be described in greater detail, which is adapted to make smaller the absolute value |Vtp 1| of the threshold voltage of P channel MOS transistor 442 than the absolute value |Vtp| of the threshold voltage of P channel MOS transistor 421.

Figure 2:
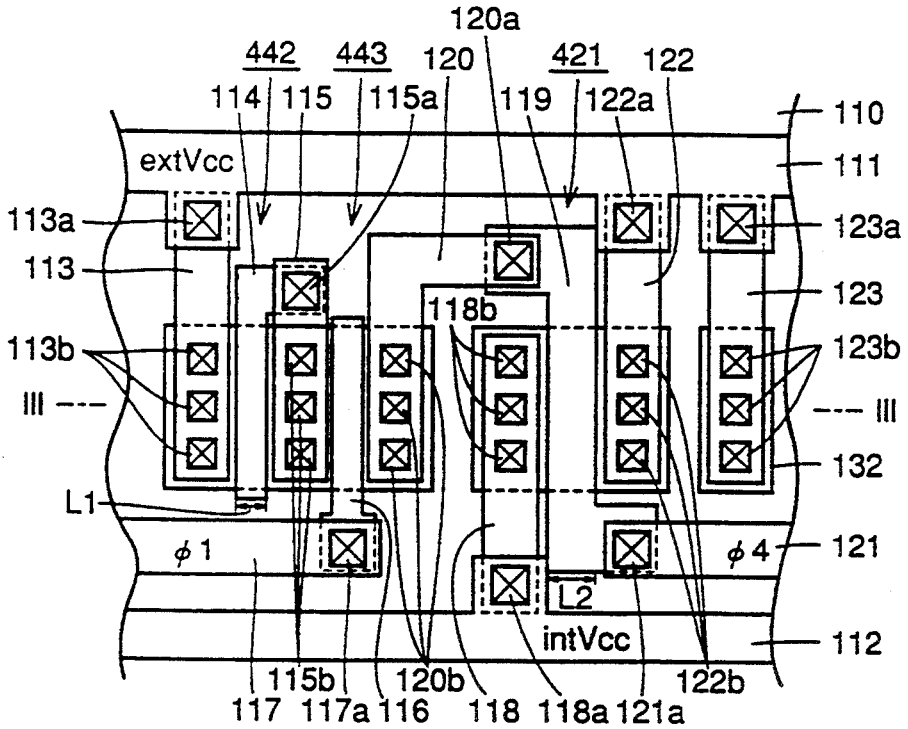
FIG. 2 is a layout showing structures of transistors included in the internal power supply circuit shown in FIG. 1.
Figure 3:
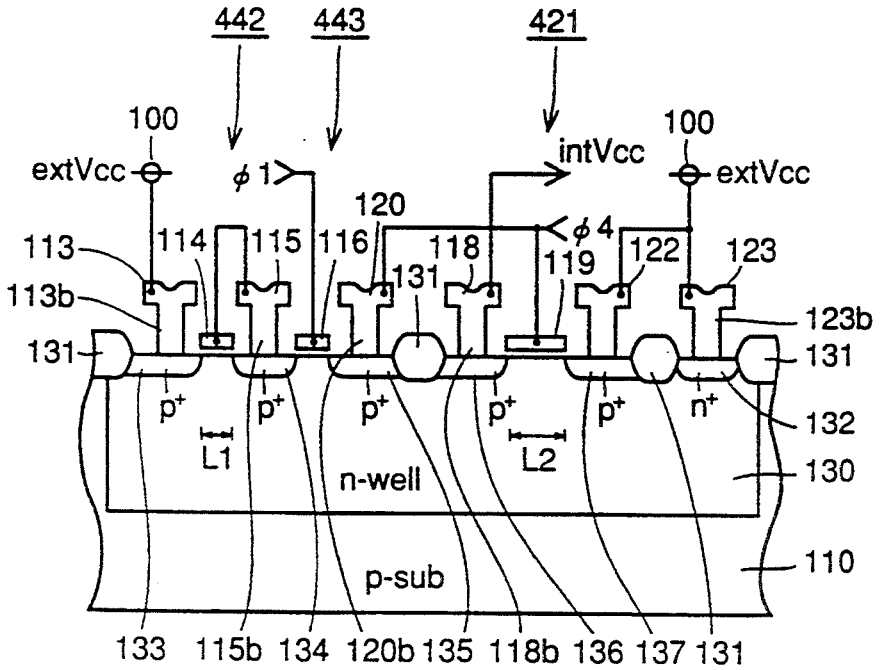
FIG. 3 is a cross section showing the transistors of FIG. 2, taken along the line III—III.

FIG. 2 is a layout showing structures of transistors 421, 442 and 443 shown in FIG. 1. FIG. 3 is a cross section of the transistors taken along the line III—III of FIG. 2.

Referring to FIG. 2, these transistors 421, 442 and 443 are formed in a P type semiconductor substrate 110. On semiconductor substrate 110, there are further provided an external power supply line 111 to which external power supply potential extVcc is applied, formed of second layer of aluminum interconnection, and an internal power supply line 112 to which internal power supply potential intVcc is applied, formed of the second layer of aluminum interconnection.

External power supply line 111 is connected to the first layer of aluminum interconnection 113 through a contact hole 113*a*, and the aluminum interconnection 113 is further connected to a source electrode 133 of P channel MOS transistor 442 through a contact hole 113*b*.

An interconnection 114 constituting the gate electrode of transistor 442 is formed of polycrystalline silicon which is at a lower layer than the first layer of aluminum interconnection. The interconnection 114 constituting the gate electrode of transistor 442 is connected to interconnection 115 through a contact hole 115*a*, and further to the source/drain electrode 134 serving as the drain electrode of transistor 442 and source electrode of transistor 443 through a contact hole 115*b*.

An interconnection 116 constituting the gate electrode of transistor 443 is formed of polycrystalline silicon, and it is connected to the first layer of aluminum interconnection 117 to which control signal $\phi$1 is applied, through a contact hole 117*a*.

Meanwhile, internal power supply line 112 is connected to the first layer of aluminum interconnection 118 through a contact hole 118*a*, and the aluminum interconnection 118 is connected to drain electrode 136 of P channel MOS transistor 421 through a contact hole 118*b*. Interconnection 119 constituting the gate electrode of transistor 421 is formed of polycrystalline silicon, and it is connected to the first layer of aluminum interconnection 120 through a contact hole 120*a*. Aluminum interconnection 120 is connected to the drain electrode 135 of P channel MOS transistor 443 through a contact hole 120*b*. Interconnection 119 constituting the gate electrode of transistor 421 is connected to the first layer of aluminum interconnection 121 to which control signal $\phi$4 is applied, through a contact hole 121*a*.

External power supply line 111 is connected to the first layer of aluminum interconnection 122 through a contact hole 122*a*, and the aluminum interconnection 122 is connected to the source electrode 137 of transistor 421 through a contact hole 122*b*. The external power supply line 111 is connected to the first layer of aluminum interconnection 123 through a contact hole 123*a*, and the aluminum interconnection 123 is connected to the electrode 132 for applying a well potential, through a contact hole 123*b*.

Meanwhile, an N type well 130 is formed in the semiconductor substrate 110. An element isolating region 131 of silicon oxide is formed on semiconductor substrate 110. On N type well 130, an N type diffusion region 132 is formed, which diffusion region 132 provides an electrode for applying the external supply potential extVcc to N type well 130.

On N type well 130, P type diffusion regions 133 to 137 are formed. Diffusion region 133 serves as the source electrode of P channel MOS transistor 442. Diffusion region 134 serves as the drain electrode of the P channel MOS transistor 442 as well as the source electrode of P channel MOS transistor 443.

Diffusion region 135 serves as the drain electrode of transistor 443. Diffusion region 136 constitutes the drain electrode of the P channel MOS transistor 421. Diffusion region 137 constitutes the source electrode of transistor 421.

Here, channel length L1 of transistor 442 is made shorter than the channel length L2 of transistor 421. Therefore, the absolute value |Vtp1| of the threshold voltage of transistor 442 is smaller than the absolute value |Vtp| of the threshold voltage of transistor 421. Therefore, while the control signal $\phi$1 is at the L level, that is, when the differential amplifying circuit 422 is not activated, transistor 421 is rendered slightly non-conductive.

The operation of the internal power supply circuit in accordance with the first embodiment will be described with reference to the timing chart of FIG. 4.

Figure 4:
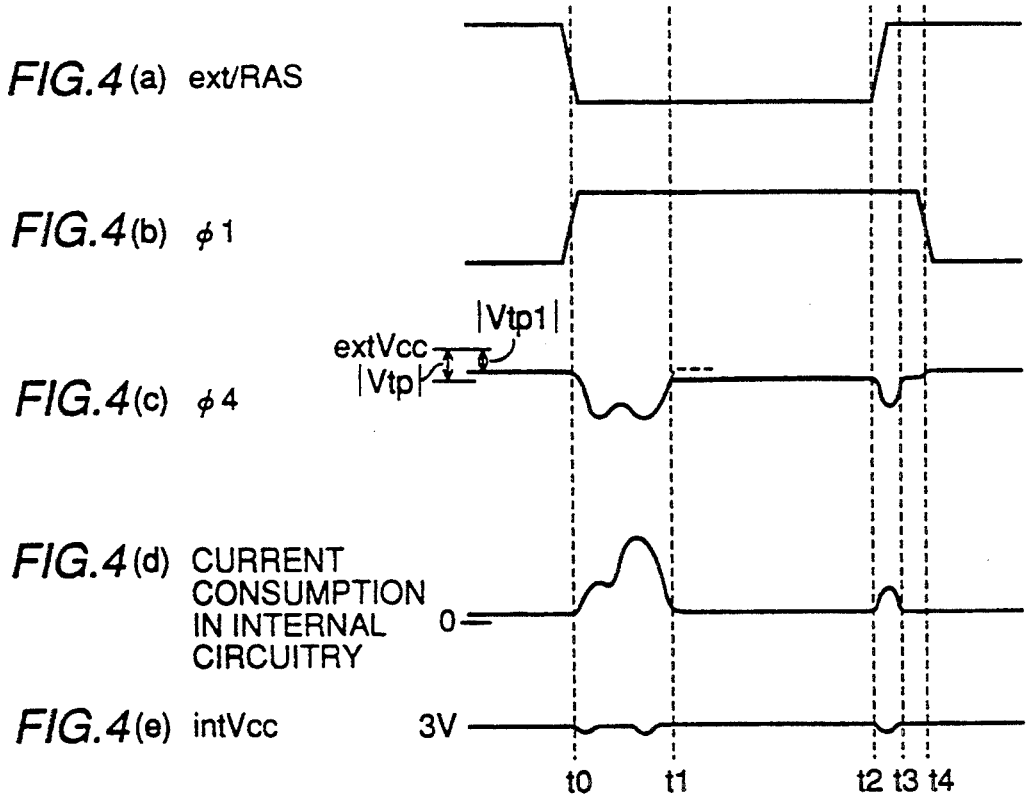
FIG. 4 is a timing chart showing the operation of the internal power supply circuit shown in FIG. 1.

Referring to FIG. 4(*a*), before time t0, when external row address strobe signal ext/RAS is at H level, delay circuit 301 in control circuit 30 provides a delayed signal which is at the H level, and NAND gate 302 provides a control signal $\phi$1 of L level in response to these H level signals, as shown in FIG. 4(*b*).

Figure 17:
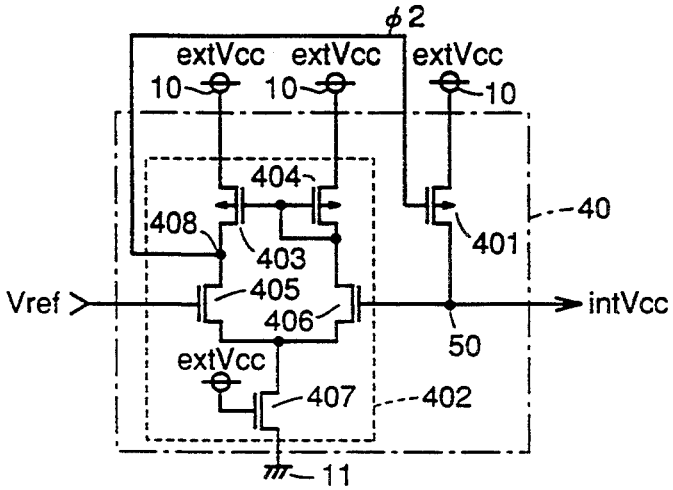
FIG. 17 PRIOR ART
FIG. 17 is a schematic diagram showing the structure of the main internal power supply potential generating circuit in the internal power supply circuit of FIG. 16.

Main internal power supply potential generating circuit 40 having small current supplying capability and small power consumption operates in the similar manner as the conventional main internal power supply potential generating circuit 41 shown in FIG. 17, such that the internal power supply potential intVcc becomes equal to the reference potential Vref, based on the reference potential Vref (of, for example, 3 V) output from reference potential generating circuit 20.

In auxiliary internal power supply potential generating circuit 44, the L level control signal $\phi$1 is applied to the gate of N channel MOS transistor 428, so that transistor 428 is rendered non-conductive. Therefore, the ground potential is not supplied to the sources of N channel MOS transistors 426 and 427, and therefore the differential amplifying circuit 422 does not operate.

Meanwhile, the P channel MOS transistor 443 in standby potential supplying circuit 441 is rendered conductive, as the L level control signal $\phi$1 is applied to the gate thereof.

When the control potential $\phi$4 applied to the gate of transistor 421 is lower than a prescribed potential, the diode connected P channel MOS transistor 442 is rendered conductive, whereby charges are supplied from external power supply node 10 to the gate of transistor 421, through transistors 442 and 443. Here, the prescribed potential means the potential extVcc—|Vtp1| (for example 4.1 V), which is lower than the external power supply potential extVcc (of, for example, 5 V) by the absolute value |Vtp1| (for example, 0.9 V) of the threshold voltage of P channel MOS transistor 442.

Transistor 4421 is rendered non-conductive when charges are supplied to its gate and the control potential $\phi$4 increases to the prescribed potential extVcc—|Vtp1|.

Since the standby potential supplying circuit 441 sets the control potential $\phi$4 to the potential extVcc |Vtp1| (for example, 4.1 V) which is lower than the external power supply potential extVcc by the absolute value |Vtp1| of the threshold voltage of transistor 442, transistor 421 is always kept conductive, and therefore internal power supply potential intVcc is prevented from being equal to external power supply potential extVcc.

More specifically, if auxiliary internal power supply potential generating circuit 44 is not provided with the standby potential supplying circuit 441, the differential amplifying circuit 4422 provides a control signal $\phi$4 which has stable L level through output node 429, so that transistor 429 is always kept conductive, causing conduction between external power supply node 10 and internal power supply node 50.

Since the voltage, between the source and gate of transistor 421 is little smaller than the absolute value |Vtp| of the threshold voltage thereof, a subthreshold current flows from external power supply node 10 to output node 50 through transistor 421. Thus, the auxiliary internal power supply potential generating circuit 44 assists main internal power supply potential generating circuit 40 for supplying the standby current consumed in internal circuitry 1.

Then, referring to FIG. 4(*a*), when external row address strobe signal ext/RAS attains to the L level at time t0, NAND gate 302 in control circuit 30 outputs a control signal $\phi$1 at the H level as shown in FIG. 4 (*b*) in response to the L level row address strobe signal ext/RAS. At this time, main internal power supply potential generating circuit 40 operates in the same manner as in the case when control signal $\phi$1 is at the L level.

In auxiliary internal power supply potential generating circuit 44, N channel MOS transistor 428 in differential amplifying circuit 421 is rendered conductive, receiving control signal $\phi$1 of H level at its gate. In standby potential supplying circuit 441, P channel MOS transistor 443 receives the control signal $\phi$1 of H level at its gate, and rendered non-conductive. Therefore, the differential amplifying circuit 422 starts its operation.

When row address strobe signal ext/RAS attains to the L level, internal circuitry 1 is activated and starts its operation. At this time, referring to FIG. 4(*d*), current of about 100 mA in average and several hundreds mA at most is consumed in internal circuitry 1. Consequently, internal power supply potential intVcc lowers slightly, as shown in FIG. 4(*e*). In response, the control potential $\phi$4 output from differential amplifying circuit 422 begins to decrease from the prescribed potential extVcc—|Vtp1| (for example, 4.1 V) as shown in FIG. 4(*c*), and immediately becomes lower than the prescribed potential extVcc—|Vtp| (4.0 V). Consequently, transistor 421 is rendered conductive, and charges are supplied from external power supply node 10 to output node 50 through transistor 421.

Then, at time t1, when internal circuitry 1 finishes its operation such as data reading from a memory cell and current consumption thereof is reduced, internal power supply potential intVcc increases. Consequently, control potential $\phi$4 from differential amplifying circuit 422 increases to the potential $\phi$extVcc—|Vtp| which is lower than the external power supply potential extVcc (for example, 5 V) by the absolute value |Vtp| (for example, 1 V) of the threshold voltage of transistor 421, as shown in FIG. 4(*c*). Therefore, transistor 421 is rendered non-conductive, and supply of charges to output node 50 is stopped. Then, at time t2, when row address strobe signal ext/RAS attains to the H level, a reset current flows through internal circuitry 1, as an I/O line 1 which is at the internal supply potential intVcc is precharged to the intermediate potential ($\frac{1}{2}$) intVcc of the internal power supply potential intVcc, for example, from time t2 to t3, as shown in FIG. 4(*d*).

Taken into account the reset current, the control signal $\phi$1 provided from control circuit 30 is adapted to fall to the L level at time t4 after a delay time determined by the delay circuit 301, from the time t2 at which the row address strobe signal ext/RAS rises to the H level, as shown in FIG. 4(*b*).

When the control signal $\phi 1$ of the L level is applied to the gate of transistor 443 of the standby potential supplying circuit 441, the control potential $\phi 4$ is precharged to the potential extVcc—|Vtp1| (for example, 4.1 V) which is lower than the external power supply potential extVcc by the absolute value |Vtp1| of the threshold voltage of transistor 422, as shown in FIG. 4(*c*). Therefore, transistor 421 is again rendered non-conductive.

In the internal power supply circuit in accordance with the first embodiment, while the control signal $\phi 1$ is at the L level, that is, when the auxiliary internal power supply potential generating circuit 44 is not activated, a control potential $\phi 4$ (for example, 4.1 V) which is lower than the external power supply extVcc by the absolute value |Vtp1| (for example, 0.9 V) of the threshold voltage of transistor 442 is applied to the gate of transistor 421, and therefore transistor 421 is kept at a slightly non-conductive state.

Accordingly, compared with a case in which transistor 421 is fully non-conductive with the external power supply potential extVcc applied to the gate of transistor 421, the gate potential of transistor 421 immediately lowers to the prescribed potential extVcc—|Vtp| (for example, 4.0 V) when the control signal $\phi 1$ attains to the H level. Therefore, transistor 421 is quickly rendered conductive.

In order to increase current driving capability of transistor 421 in auxiliary internal power supply potential generating circuit 44, the gate width is enlarged so as to increase capacitance. Consequently, rather than rendering fully conductive the transistor 421 by applying the external supply potential extVcc to the gate of transistor 421, the transistor 421 is rendered slightly conductive by applying a prescribed potential extVcc—|Vtp1| (for example, 4.1 V) which is lower than the external power supply potential extVcc, since amount of charges for charging the gate electrode can be made smaller, which leads to reduce power consumption.

In the standby potential supplying circuit 441, the diode connected transistor 442 is not connected to the side of gate electrode of transistor 421 but to the side of the external power supply node 10. Therefore, the load capacitance of differential amplifying circuit 422 is determined only by the gate capacitance of transistor 421 and pn junction capacitance of transistor 443. If the diode connected transistor 442 is connected to the side of the gate electrode of transistor 421, the load capacitance of differential amplifying circuit 422 will be larger by the gate capacitance of transistor 442.

As described above, the load capacitance of differential amplifying circuit 422 is relatively small, and therefore the differential amplifying circuit 442 can quickly change the gate potential of transistor 421. Therefore, the internal power supply circuit can supply a stable internal power supply potential intVcc to the internal circuitry 1.

Assuming that in this first embodiment, external power supply potential extVcc is 5 V, the absolute value |Vtp| of the threshold voltage of transistor 421 is 1.0 V and the absolute value |Vtp1| of the threshold voltage of transistor 442 is 0.9 V, transistor 421 is rendered conductive when its gate potential becomes lower than 4 V (=extVcc—|Vtp|).

Therefore, as compared with a case when the gate potential is lowered from 5 V (=extVcc), the transistor 421 can be rendered conductive faster when the gate potential thereof is lowered from 4.1 V (=extVcc—|Vtp1|). Assuming that it takes 1 nsec to lower the gate potential by 0.1 V, the transistor 421 can be rendered conductive faster by 9 nsec.

Assuming that the standby potential supplying circuit 441 charges the gate electrode of transistor 421, receiving a current of 1 $\mu$A from external power supply node 10, power consumption can be reduced by 0.9 $\mu$W {=1 $\mu$A·(5 V−4.1 V)}.

Since the driving transistor 441 and the transistor 442 for lowering voltage are formed to have the same conductivity type in this first embodiment, what is necessary is to make shorter the channel length of voltage lower transistor 442 than the channel length of driving transistor 421. Therefore, the absolute value |Vtp1| of the threshold voltage of the voltage lowering transistor can be made smaller than the absolute value |Vtp| of the threshold voltage of driving transistor easily without increasing any additional step.

[Embodiment 2]

Figure 5:
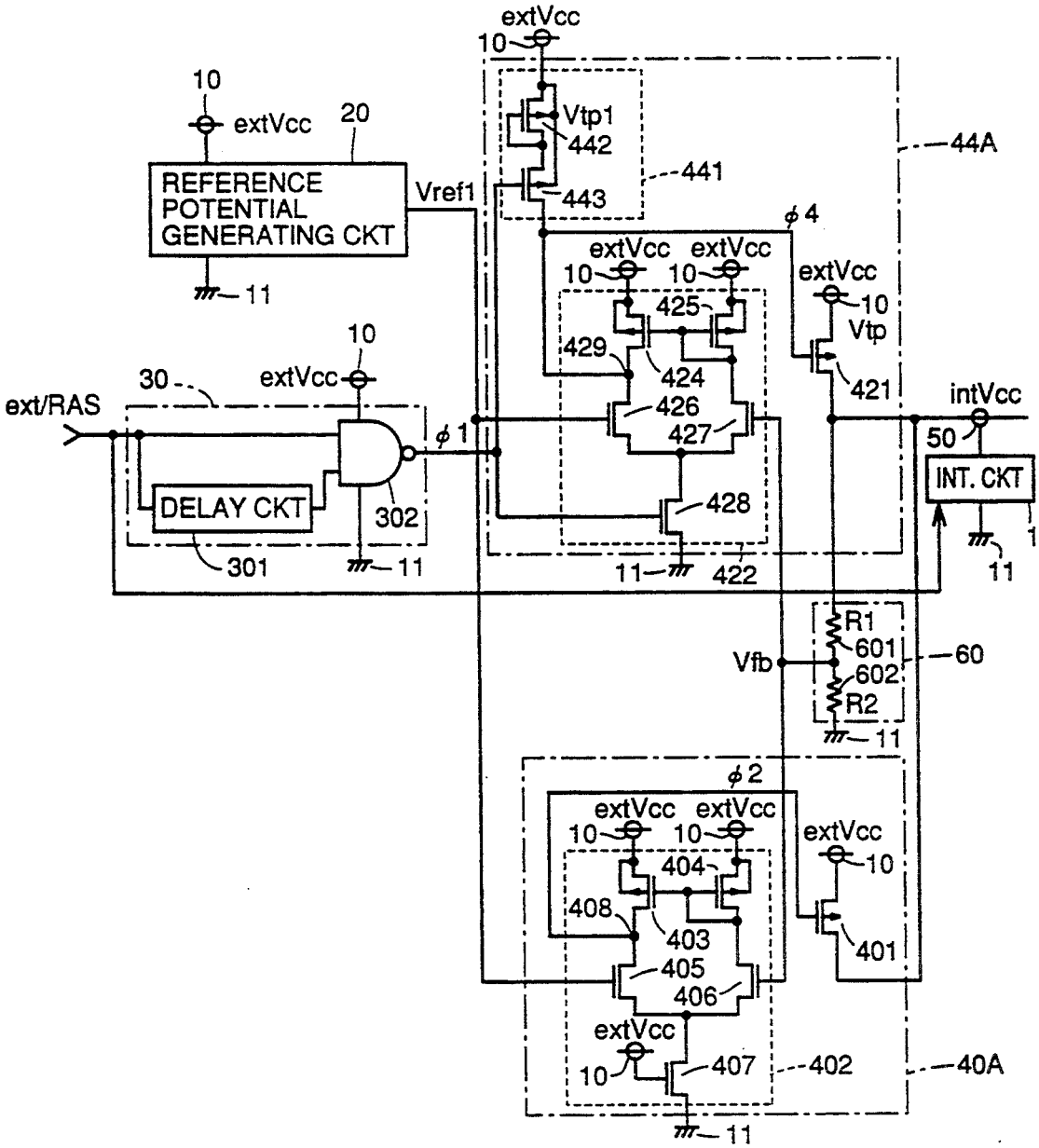
FIG. 5 is a block diagram showing a structure of the DRAM including the internal power supply circuit in accordance with the second embodiment of the present invention.

FIG. 5 is a block diagram showing a structure of the DRAM including an internal power supply circuit in accordance with a second embodiment of the present invention.

Referring to FIG. 5, the internal power supply circuit includes, similar to the first embodiment described above, a reference potential generating circuit 20, a control circuit 30, a main internal power supply potential generating circuit 40*a* and an auxiliary internal power supply potential generating circuit 44*a*, and it further includes, different from the first embodiment, a feed back circuit 60. Feed back circuit 60 includes two resistors 601 and 602 which are connected in series between an output node 50 and the ground node 11.

Namely, the second embodiment differs from the above described first embodiment in that the internal power supply potential intVcc generated at output node 50 is not directly feedback to differential amplifying circuit 402 and 422 but the internal power supply potential intVcc is subjected to resistive division by resistors 601 and 602, and the divided feedback potential Vfb is feedback to differential amplifying circuits 402 and 422. Therefore, differential amplifying circuit 402 compares the feedback potential Vfb which changes in response to the internal power supply potential intVcc with the reference potential Vref1, and in response to the result of comparison, provides a control potential $\phi 2$.

Control circuit 422 compares the feedback potential Vfb which changes in response to the internal power supply potential intVcc with the reference potential Vref1, and provides a control potential $\phi 4$ in response to the result of comparison.

The feedback potential Vfb is one of the potentials which change in response to the internal power supply potential intVcc. When the internal power supply potential intVcc is directly feedback to the differential amplifying circuit 402 or 422 as in the first embodiment, the feedback potential is equal to the internal power supply potential intVcc. The feedback potential intVcc in that case is also one of the potentials which change in response to the internal power supply potential intVcc.

In the second embodiment, the feed back potential Vfb which is lower than the internal power supply potential intVcc is compared with the reference potential Vref1. Therefore, in order to generate the same internal power supply potential intVcc (for example 3 V) as in the first embodiment, the reference potential Vref generated from reference potential generating circuit 20 is set to be lower than the reference potential Vref in the first embodiment. When the value R1 of resistor 601 is the same as the value R2 of resistor 602, the reference potential Vref is set to 1.5 V.

The values R1 and R2 of resistors 601 and 602 of feedback circuit 60 are set to be higher than 1MΩ in order to reduce through current flowing from output node 50 through resistors 601 and 602 to the ground node 11. To obtain such a high resistance value by a smaller area, a channel resistance MOS transistor is used, for example.

The operation of the internal power supply circuit in accordance with the second embodiment will be described.

Auxiliary internal power supply potential generating circuit 44A and main internal power supply potential generating circuit 40A supply charges to output node 50 through transistors 421 and 401, respectively, when the feedback potential Vfb from feedback circuit 60 becomes lower than the reference potential Vref1 from reference potential generating circuit 20.

When feedback potential Vfb becomes higher than the reference potential Vref1, these circuits stop supply of charges to output node 50.

In this manner, main internal power supply potential generating circuit 40A and auxiliary internal power supply potential generating circuit 44A both operate so that feedback potential Vfb becomes equal to the reference potential Vref1. More specifically, there is a relation between the feedback potential Vfb and the internal power supply potential intVcc that intVcc=(1+R1/R2) Vfb, and therefore main internal power supply potential generating circuit 40A and auxiliary internal power supply potential generating circuit 44A operate so that internal power supply potential intVcc becomes equal to (1+R1/R2) Vref1.

Other than the abode described operation, the second embodiment is substantially the same as the first embodiment.

The second embodiment provides the same effect as the first embodiment described above, and in addition, it provides the following effect. More specifically, in the second embodiment, both in the differential amplifying circuits 402 and 422, the feedback potential Vfb lower than the internal power supply potential intVcc is compared with the reference potential Vref1 lower than the reference potential Vref in the first embodiment and amplified, and therefore these differential amplifying circuits 402 and 422 have large gain and high sensitivity. Thus internal power supply potential intVcc of high precision can be generated.

[Embodiment 3]

Figure 6:
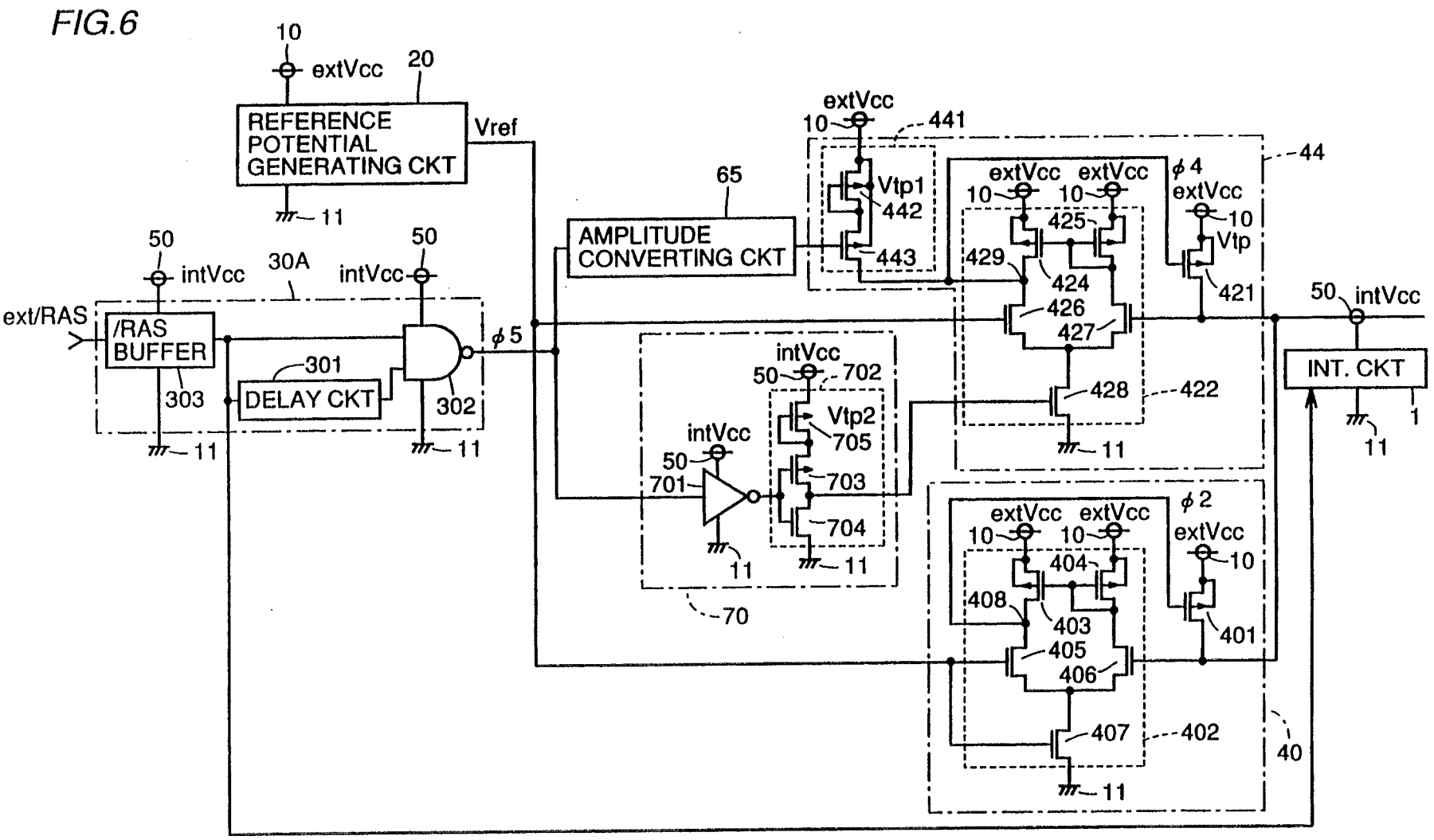
FIG. 6 is a block diagram showing the structure of the DRAM including the internal power supply circuit in accordance with the third embodiment of the present invention.

FIG. 6 is a block diagram showing a structure of the DRAM including the internal power supply circuit in accordance with the third embodiment of the present invention.

Referring to FIG. 6, the internal power supply circuit includes a reference potential generating circuit 20, a control circuit 30A, a main internal power supply potential generating circuit 40, an auxiliary internal power supply potential generating circuit 44, an amplitude converting circuit 60 and a level shift circuit 70.

Third embodiment differs from the above described first embodiment in the following points.

First, control circuit 30A operates based on the internal power supply potential intVcc. Control circuit 30*a* includes a/RAS buffer 303, a delay circuit 301, and an NAND gate 302. /RAS buffer 303 is connected between an internal power supply node (output node) 50 and the ground node 11, and generates an internal row address strobe signal/RAS in response to an external row address strobe signal ext/RAS. The external row address strobe signal ext/RAS swings between external power supply potential extVcc (of, for example, 5 V) and the ground potential. Internal row address strobe signal/RAS swings between internal power supply potential intVCC (of, for example, 3 V) and the ground potential.

Delay circuit 301 is also connected between internal power supply node 50 and the ground node 11, and provides a prescribed delay to the internal row address strobe signal/RAS. NAND gate 302 is also connected between internal power supply node 50 and the ground node 11 and provides a control signal $\phi$5 in response to the internal row address strobe signal delayed by the delay circuit 301 as well as the internal row address strobe signal/RAS.

In this manner, control circuit 30A generates, in response to external row address strobe signal ext/RAS having the amplitude of the external power supply potential extVcc, a control signal $\phi$5 having the amplitude of internal power supply potential intVcc.

Second, a reference voltage Vref is applied to the gate of N channel MOS transistor 407 in auxiliary internal power supply potential generating circuit 40.

Third, control signal $\phi$5 is applied to the gate of P channel MOS transistor 443 in main internal power supply potential generating circuit 44 through amplitude converting circuit 65. Amplitude converting circuit 65 converts the amplitude of control signal $\phi$5 to the amplitude of external power supply potential extVcc.

Figure 7:
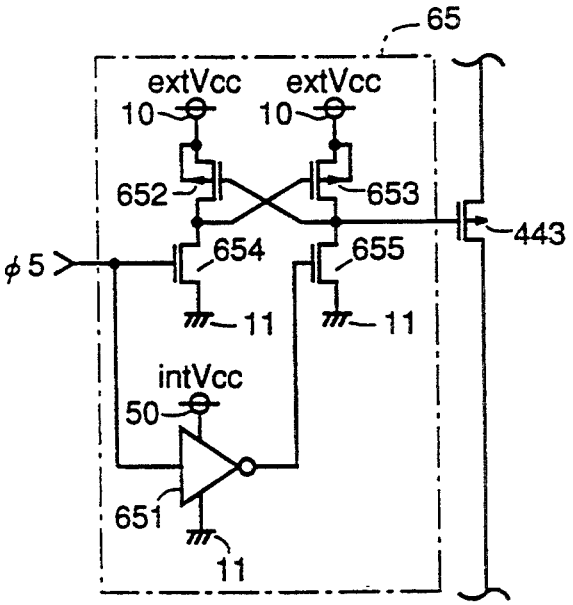
FIG. 7 is a schematic diagram showing an amplitude converting circuit in the internal power supply circuit shown in FIG. 6.

FIG. 7 is a schematic diagram showing the amplitude converting circuit 65.

Referring to FIG. 7, amplitude converting circuit 65 includes an inverter 651, P channel MOS transistors 652 and 653, and N channel MOS transistors 654 and 655. Inverter 651 is connected between internal power supply node 50 and ground node 11, receives control signal $\phi$5 from control circuit 30A and provides an inverted signal thereof. P channel MOS transistor 652 has its source connected to external power supply node 10, and its gate connected to the gate of P channel MOS transistor 443 in standby potential supplying circuit 441. P channel MOS transistor 653 is connected between external power supply node 10 and the gate of transistor 443, and the gate of this transistor is connected to the drain of transistor 652. N channel MOS transistor 654 is connected between the drain of transistor 652 and the ground node 11, and receives at its gate the control signal $\phi$5. N channel MOS transistor 655 is connected between the gate of transistor 443 and the ground node 11, and receives at its gate the inverted control signal /$\phi$5 inverted by inverter 651.

Fourth, the control signal $\phi$5 is applied to the gate of N channel MOS transistor 28 in auxiliary internal power supply potential generating circuit 44 through level shift circuit 70. Level shift circuit 50 includes an inverter 701 operating based on internal power supply potential intVcc and a level shift inverter 702 which also operates based on internal power supply potential intVcc.

Level shift inverter 702 includes a CMOS inverter consisting of a P channel MOS transistor 703 and an N channel MOS transistor 704, and a diode connected P channel MOS transistor 705. Transistor 705 has a prescribed threshold voltage Vtp2 (of, for example, −0.7 V), and it is connected between internal power supply node 50 and the source of transistor 703. Therefore, this transistor 705 supplies a potential intVcc—|Vtp2| (of, for example, 2.3 V) which is lower than the internal power supply potential intVcc by the absolute value |Vtp2| of the threshold voltage thereof, to the source of transistor 703.

Accordingly, level shift circuit 70 reduces the amplitude of control signal $\phi$5 and applies this signal with the reduced amplitude to the gate of N channel MOS transistor 428 in auxiliary internal power supply potential generating circuit 44.

The operation of the internal power supply circuit will be described.

The operation of the internal power supply circuit is approximately the same as that of the internal power supply circuit in accordance with the first embodiment shown in the timing chart of FIG. 4, except that the control signal $\phi$5 has the amplitude of internal power supply potential intVcc.

First, as shown in FIG. 4(*a*), before time t0, when the external row address strobe signal ext/RAS is at the H level, the internal row address strobe signal/RAS from RAS buffer 303 attains to the H level which is approximately the internal power supply potential intVcc, and the output signal from delay circuit 301 also attains to the H level. Therefore, in response to the internal row address strobe signal/RAS and the output from delay circuit 301 which are at the H level, AND gate 302 provides the control signal $\phi$5 which is approximately at the ground potential (L level).

In response to the control signal $\phi$5, inverter 701 in level shift circuit 70 provides a signal which is approximately at the internal power supply potential intVcc (H level), and in response to this signal, level shift inverter 702 supplies the ground potential (L level) to the gate of N channel MOS transistor 428 in auxiliary internal power supply potential generating circuit 44. Consequently, transistor 428 is rendered non-conductive, and the differential amplifier 422 does not operate.

Meanwhile, when a control signal $\phi$5 of the L level is applied to amplitude converting circuit 65, N channel MOS transistor 654 in amplitude converting circuit 65 is rendered non-conductive, and inverter 651 provides a signal of the internal power supply potential intVcc level (H level) to the gate of N channel MOS transistor 655. Consequently, transistor 655 is rendered conductive.

When transistor 655 is rendered conductive, the gate potential of P channel MOS transistor 652 lowers, so that transistor 652 is rendered conductive. When transistor 652 is rendered conductive, gate potential of P channel MOS transistor 655 increases, and transistor 655 is rendered non-conductive.

Consequently, the ground potential is applied to the gate of transistor 443 in standby potential supplying circuit 441 from amplitude converting circuit 65, so that transistor 443 is rendered conductive.

When transistor 443 is rendered conductive, a potential extVcc—|Vtp1| which is lower than the external power supply potential extVcc by the absolute value |Vtp1| of the threshold voltage of transistor 442 is applied to the gate of transistor 441 as in the first embodiment, so that transistor 421 is rendered slightly non-conductive.

Then, when external row address strobe signal ext/RAS attains to the L level, /RAS buffer 303 in control circuits 30A provides an internal row address strobe signal/RAS which is approximately at the ground potential (L level). In response to the internal row address strobe signal/RAS, NAND gate 302 provides the control signal $\phi$5 which is approximately at the internal power supply potential intVcc (H level). In response to the control signal $\phi$5 of the H level, inverter 701 in level shift circuit 70 provides a signal of approximately the ground potential (L level), and in response to this signal, level shift inverter 702 provides a potential intVcc—|Vtp2| (of, for example, 3.3 V) which is lower than the internal power supply potential intVcc by the absolute value of the threshold voltage of transistor 705. More specifically, in the level shift inverter 702, p channel MOS transistor 703 is rendered conductive in response to the L level signal provided from 701, and N channel MOS transistor 704 is rendered non-conductive. Consequently, internal power supply potential intVcc is lowered by the absolute value |Vtp2| of the threshold voltage thereof by means of transistor 705, and the lowered potential intVcc—|Vtp2| is applied to the gate of N channel MOS transistor 428 in auxiliary internal power supply potential generating circuit 44 through transistor 703. Consequently, transistor 428 is rendered conductive, and differential amplifying circuit 422 starts its operation.

When the control signal $\phi$5 of the H level is applied to amplitude converting circuit 65, transistor 654 in amplitude converting circuit 65 is rendered conductive, whereby gate potential of the transistor 653 decreases, rendering conductive the transistor 653.

In response to the control signal $\phi$5 of the H level, inverter 651 applies a signal at the ground potential (L level) to the gate of transistor 655. Consequently, transistor 655 is rendered non-conductive, gate potential of transistor 652 increases, and the transistor 652 is rendered non-conductive. Consequently, the external power supply potential extVcc is applied to the gate of the transistor 443 in standby potential supplying circuit 441 from amplitude converting circuit 65, so that the transistor 443 is rendered non-conductive. Therefore, the auxiliary internal power supply potential generating circuit 44 starts its operation in the similar manner as in the first embodiment.

In addition to the effects similar to those of the first embodiments, the internal power supply circuit in accordance with the third embodiment provides the following effects.

Namely, in the third embodiment, to the gate of N channel MOS transistor 407 in differential amplifying circuit 402, a potential lower than the first embodiment (for example, 3 V, as compared with 5 V in the first embodiment) is applied, and to the gate of N channel MOS transistor 428 in differential amplifying circuit 422, a potential lower than the first embodiment (for example, 2.3 V as compared with 5 V in the first embodiment) is applied. Therefore, the voltage between the drain and the source at which the transistors 407 and 421 are saturated is made lower. Consequently, these differential amplifying circuits 402 and 422 have large gain and high sensitivity, and as a result, a stable internal power supply potential intVcc can be obtained.

For example, when the internal power supply potential intVcc applied to the gate of transistor 427 in differential amplifying circuit 422 becomes higher than the reference potential Vref applied to the gate of transistor 426 and the, current flowing through transistor 427 is increased, the current mirror circuit constituted by transistors 424 and 425 operates to provide the same amount of current to transistors 426 and 427. However, since the current flowing in transistor 426 is smaller than the current flowing in transistor 427, the potential at output node 429 increases.

In addition, since the gate potential of transistor 428 is low, it is immediately saturated. A current higher than the saturation current cannot flow through transistor 428. Therefore, when current flowing through transistor 427 increases, the drain potential of transistor 428 increases. This drain potential is transmitted through transistor 426 to output node 429, further increasing the potential of output node 429.

In this manner, since a relatively low potential is applied to the gate of transistor 428 of differential amplifying circuit 422, it is immediately saturated. This increases the gain of the differential amplifying circuit 422.

[Embodiment 4]

Figure 8:
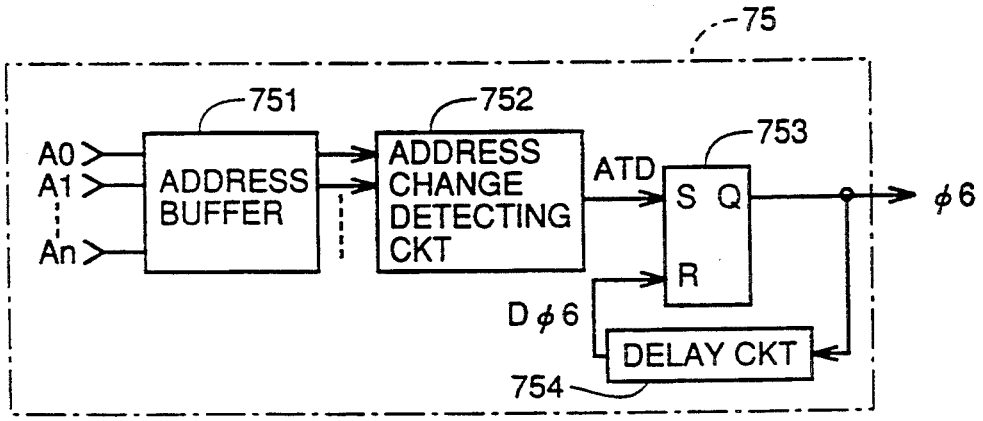
FIG. 8 is a block diagram showing a structure of a control circuit in the internal power supply circuit in accordance with the fourth embodiment of the present invention.

FIG. 8 is a block diagram showing a structure of a control circuit in the internal power supply circuit in accordance with the first embodiment of the present invention. The fourth embodiment is an application of the first invention to an SRAM (Static Random Access Memory) in which the row address strobe signal ext/RAS is not used.

The internal power supply circuit in accordance with the fourth embodiment includes, in addition to the control circuit 75, reference potential generating circuit 20, main internal power supply potential generating circuit 40, and auxiliary internal power supply potential generating circuit 44 as in the first embodiment described above.

The fourth embodiment differs from the above-described first embodiment in the following points. First, a control signal $\phi$6 attains to and kept at the H level for prescribed period in response to the change of address signals A0 to An, and, secondly, the internal circuitry is activated in response to the change of external address signals A0 to An, a memory cell corresponding to the address signal A0 to An is selected and data is output from the selected memory cell.

Referring to FIG. 8, control circuit 75 includes an address buffer circuit 751 generating an internal address signal in response to external address signals A0 to An, an address change detecting circuit 752 generating an address change signal ATD which attains to and kept at the H level in a prescribed period in response to the change of an internal address signal from address buffer circuit 751, an R-S flipflop circuit 753 which is set in response to the address change signal ATD from address change detecting circuit 752, and a delay circuit 754 for providing a delay of a prescribed time period to the control signal $\phi$6 provided from R-S flipflop circuit 753.

The delayed signal D$\phi$6 provided from delay circuit 754 is input to a reset input terminal R of R-S flipflop circuit 753. Therefor, R-S flipflop circuit 753 provides the control signal $\phi$6 of the H level when it is set in response to the address change signal ATD, and provides the control signal $\phi$6 of the L level when it is reset in response to the delayed signal D$\phi$6.

The operation of the internal power supply circuit in accordance with the fourth embodiment will be described with reference to the timing chart of FIG. 9.

Figure 9:
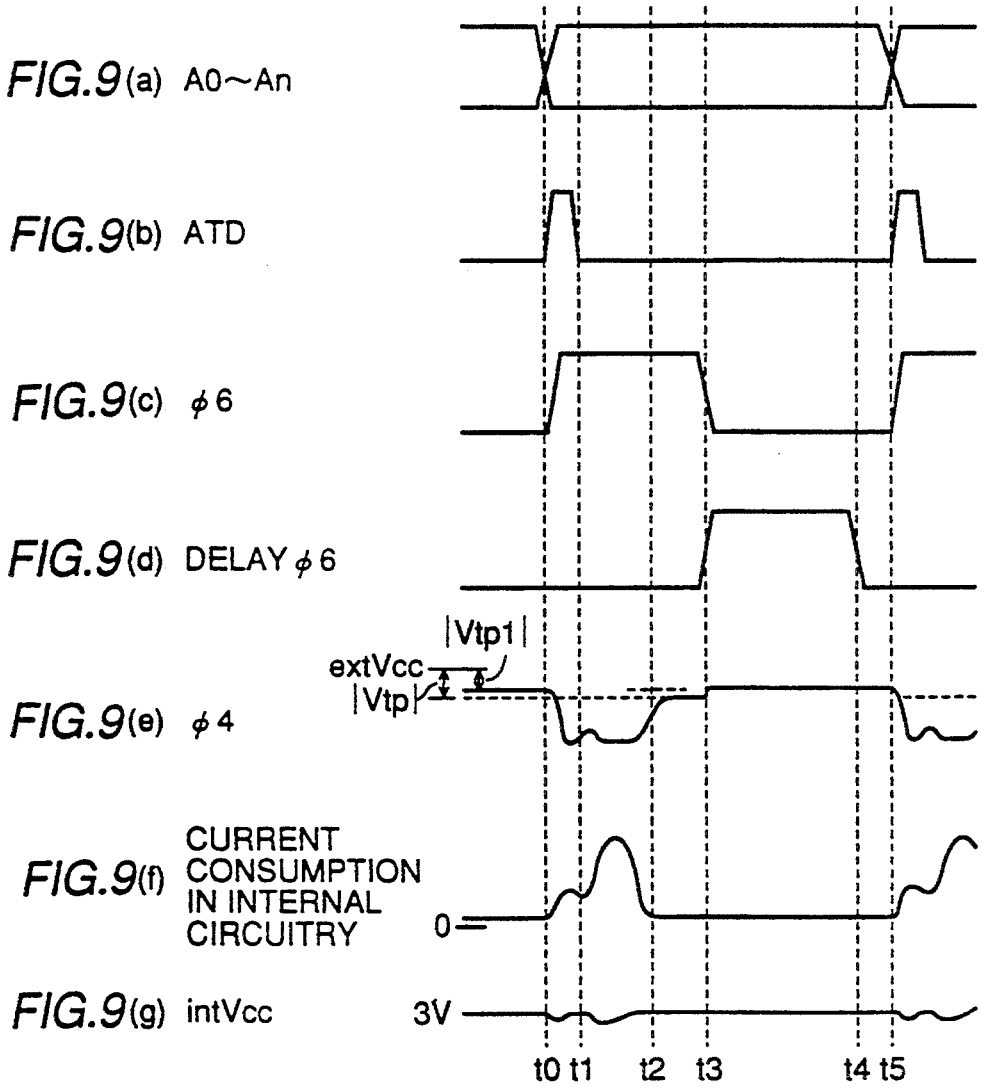
FIG. 9 is a timing chart showing the operation of the internal power supply circuit including the control circuit of FIG. 8.

Referring to FIG. 9(*a*), before time t0, external address signals A0 to An do not change. Therefore, referring to FIG. 9(*b*), the address change signal ATD provided from address change detecting circuit 752 is at L level. As shown in (*c*) and (*d*) of FIG. 9, control signal $\phi$6 and the delayed signal D$\phi$6 are both at the L level.

Since address change signal ATD and delayed signal D$\phi$6 are applied to the R-S flipflop circuit 753, the control signal $\phi$6 provided from R-S flipflop circuit 753 is maintained at the L level. When external address signals A0 to An change as shown in FIG. 9(*a*) at time t0, address change detecting circuit 752 provides an address change signal ATD which is kept at the H level from time t0 to t1, in response to the change, as shown in FIG. 9(*b*).

Referring to FIG. 9(*c*), R-S flipflop circuit 753 is reset in response to the address change signal ATD which is at the H level, and provides the control signal $\phi$6 at the H level through its output terminal Q. When control signal $\phi$6 attains to the H level at time t0, the auxiliary internal power supply potential generating circuit starts its operation in the similar manner as in the first embodiment. Consequently, the control signal $\phi$2 provided from differential amplifying circuit 422 in the auxiliary internal power supply potential generating circuit 44 lowers from a prescribed standby potential extVcc—|Vtp51 (for example, 4.1 V) as shown in FIG. 9(*e*) to a potential extVcc—|Vtp| which is lower than the external power supply potential by the absolute value of the threshold voltage of transistor 421. Thus transistor 421 is rendered conductive.

At time t2, when internal power supply potential intVcc returns to a potential which is equal to the reference potential Vref (for example 3 V) as shown in FIG. 9(*g*), the control signal $\phi$4 provided from differential amplifying circuit 422 in auxiliary internal power supply potential generating circuit 44 increases to a potential extVcc—|Vtp| which is lower than the internal power supply potential by the absolute value of the threshold voltage of transistor 421, as shown in FIG. 9(*e*). Consequently, auxiliary internal power supply potential generating circuit 44 stops supply of charges to output node 50.

Referring to FIG. 9(*d*), at time t3 after a prescribed time period from time t0, the delayed signal D$\phi$6 output from delay circuit 750 rises to the H level. The delayed signal D$\phi$6 of the H level is applied to the reset input terminal R of R-S flipflop circuit 753. As shown in FIG. 9(*c*), R-S flipflop circuit 753 is reset in response to the delayed signal D$\phi$6, and provides the control signal $\phi$6 of the L level through its output terminal Q.

At time t4, after a prescribed time period from time t3, delayed signal d$\phi$6 falls to the L level as shown in FIG. 9(*d*). When the delayed signal D$\phi$6 of the L level is input to the reset input terminal R of R-S flipflop circuit 753, R-S flipflop circuit 753 provides the control signal $\phi$6 of the L level through its output terminal Q, in response to the delayed signal D$\phi$6, as shown in FIG. 9(*c*).

At time t5, when external address signals A0 to An change again as shown in FIG. 9(*a*), the same operation as carried out from time t0 to t4 is repeated.

The internal power supply circuit in accordance with the fourth embodiment provides the similar effect as in the first embodiment, and in addition, when the internal circuitry starts its operation in response to the change of address signals A0 to An, the auxiliary internal power supply potential generating circuit 44 is activated immediately, and the current consumed in the internal circuitry can be sufficiently made up for.

[Embodiment 5]

Figure 10:
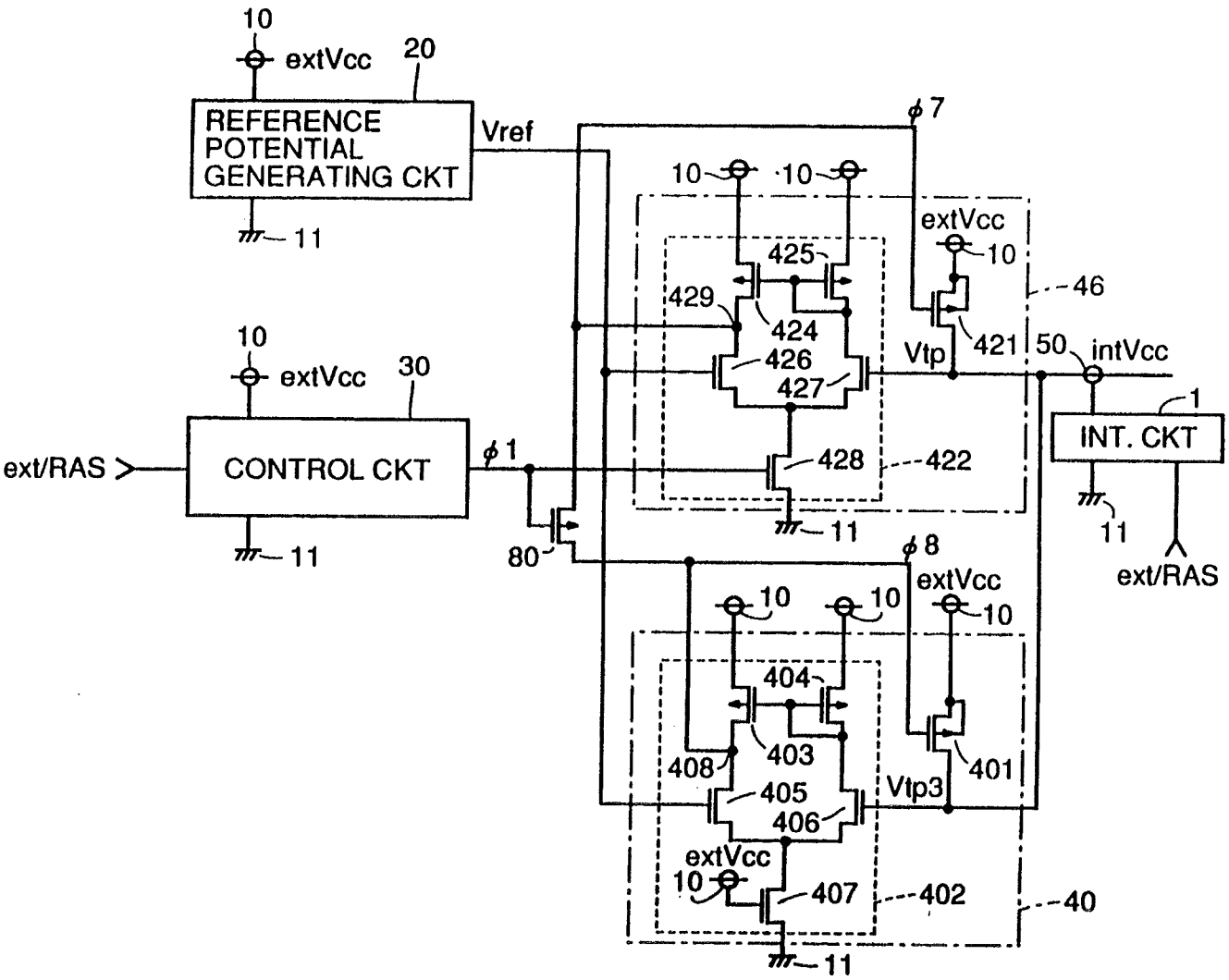
FIG. 10 is a block diagram showing a structure of the DRAM including the internal power supply circuit in accordance with the fifth embodiment of the present invention.

FIG. 10 is a block diagram showing a structure of the DRAM including the internal power supply circuit in accordance with the fifth embodiment of the present invention.

Referring to FIG. 10, the internal power supply circuit includes, as in the first embodiment, a reference potential generating circuit 20, a control circuit 30 and a main internal power supply potential generating circuit 40, and different from the first embodiment, it further includes an auxiliary internal power supply potential generating circuit 40 and a p channel MOS transistor 80.

The internal power supply circuit in accordance with the fifth embodiment differs from the first embodiment in the following points. First, auxiliary internal power supply potential generating circuit 46 is not provided with standby potential supplying circuit 441. Second, it includes a P channel MOS transistor 80.

The P channel MOS transistor 80 is connected between the gate electrode of a P channel MOS transistor 421 in auxiliary internal power supply potential generating circuit 46 and the gate of the P channel MOS transistor 401 in main internal power supply potential generating circuit 40 and receives at its gate, the control signal $\phi 1$ output from control circuit 30. Accordingly, while the control signal $\phi 1$ is at the L level, that is, while the differential amplifying circuit 422 is not activated, P channel MOS transistor 80 transmits the gate potential of transistor 401 in main internal power supply potential generating circuit 40 to the gate of transistor 421 in auxiliary internal power supply potential generating circuit 46.

The gate length of P channel MOS transistor 401 in main internal power supply potential generating circuit 40 is made shorter than the channel length of P channel MOS transistor 421 in auxiliary internal power supply potential generating circuit 46. Consequently, the absolute value $|Vtp3|$ of the threshold voltage of transistor 401 is made smaller than the absolute value $|Vtp|$ of the threshold voltage of transistor 421.

When main internal power supply potential generating circuit 40 is in operation, the gate potential of transistor 401 changes near the potential extVcc—$|Vtp3|$ which is lower than the external power supply potential by the absolute value of the threshold voltage of transistor 401, so that transistor 401 may be rendered conductive or non-conductive.

While the control signal $\phi 1$ is at the L level, the gate potential of transistor 401 is applied to the gate of transistor 421 in auxiliary internal power supply potential generating circuit 46 through transistor 80. However, since the absolute value $|Vtp|$ of the threshold voltage of transistor 421 is larger than the absolute value $|Vtp3|$ of the threshold voltage of transistor 401, transistor 421 is maintained at the non-conductive state constantly, even if the gate potential of transistor 401 fluctuates to some extent.

The operation of the internal power supply circuit will be described with reference to the timing chart of FIG. 11.

Figure 11:
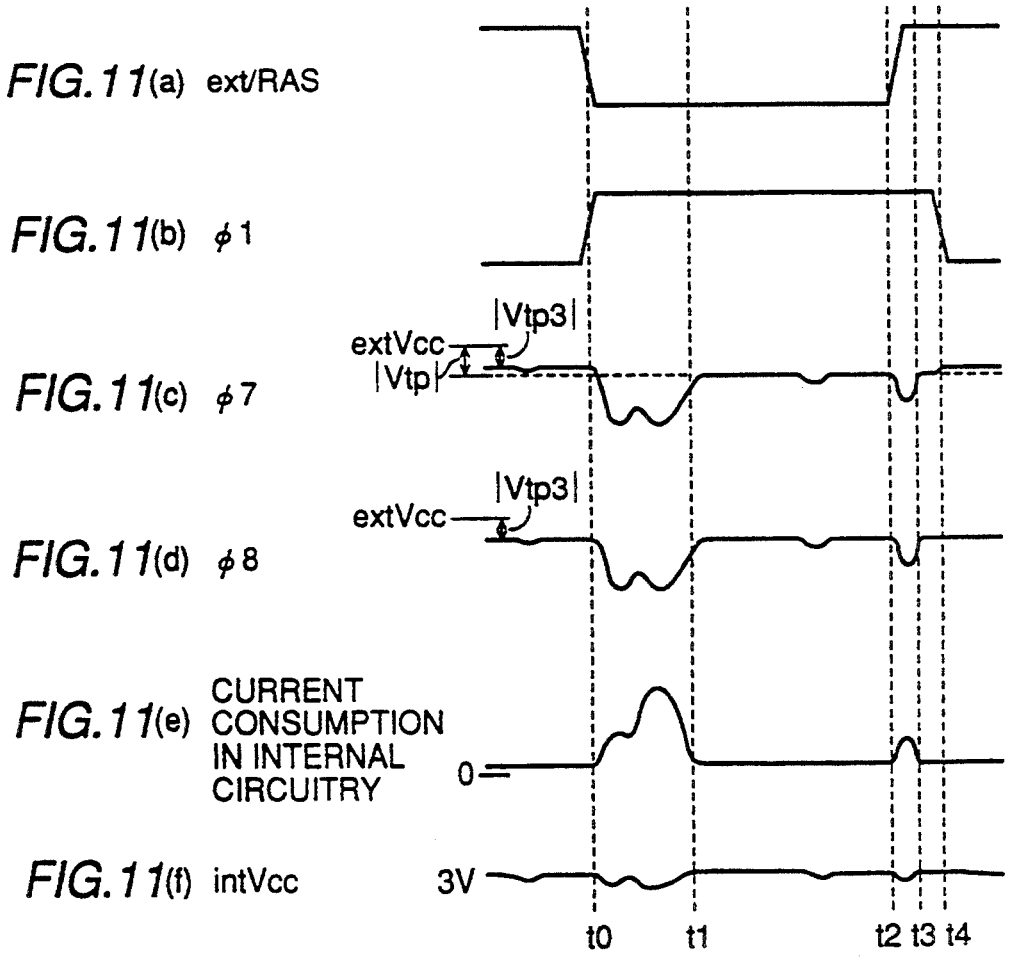
FIG. 11 is a timing chart showing the operation of the internal power supply circuit shown in FIG. 10.

First, as shown in FIG. 11(*a*), before time t0, when external row address strobe signal ext/RAS is at H level, control circuit 30 provides the control signal $\phi 1$ at the L level as shown in FIG. 11(*b*).

At this time, main internal power supply potential generating circuit 40 having small current supplying capability and small power consumption operates such that the internal power supply potential intVcc becomes equal to the reference potential Vref based on the reference potential Vref (of, for example, 3 V) supplied from reference potential generating circuit 20. Meanwhile, the N channel MOS transistor 428 in auxiliary internal power supply potential generating circuit 46 is rendered non-conductive since the control signal $\phi 1$ of the L level is applied to the gate electrode thereof. Accordingly, ground potential is not supplied to the sources of transistors 426 and 427 of differential amplifying circuit 422, and therefore the differential amplifying circuit 422 does not operate.

When the control signal $\phi 1$ at the L level is provided from control circuit 30, P channel MOS transistor 80 is rendered conductive, and the gate of transistor 401 and the gate of transistor 421 are conducted. Therefore, as shown in FIG. 11(*c*), the control potential $\phi 7$ applied to the gate of transistor 427 becomes equal to the control potential $\phi 8$ applied to the gate of transistor 401 from differential amplifying circuit 402.

Here, the absolute value $|Vtp3|$ of the threshold voltage of transistor 401 in main internal power supply potential generating circuit 40 is made smaller than the absolute value $|Vtp|$ of the threshold voltage of transistor 421 in auxiliary internal power supply potential generating circuit 46, and therefore the potential extVcc—$|Vtp|$ at which transistor 421 starts conduction is lower than the potential extVcc—$|Vtp3|$ at which transistor 401 starts conduction.

Therefore, when the internal supply potential intVcc is slightly lower than the reference potential Vref, and the control potential $\phi 8$ output from the differential amplifying circuit 402 is slightly lower than the above mentioned potential extVcc—$|Vtp3|$, only the transistor 401 is rendered conductive, and transistor 421 is rendered non-conductive.

When internal power supply potential intVcc lowers significantly from reference potential Vref and the control potential $\phi 8$ output from differential amplifying circuit 402 reaches the potential extVcc—$|Vtp|$ which is lower than the external power supply potential than the absolute value of the threshold voltage of transistor 421, transistor 421 is also rendered conductive. Since the size of transistor 421 is larger than that of transistor 401, a large amount of current is supplied to internal circuitry 1 through output node 50.

Then, as shown in FIG. 11(*a*), when row address strobe signal ext/RAS attains to the L level at time t0, the control signal $\phi 1$ output from control circuit 30 rises to the H level, as shown in FIG. 11(*b*). When control signal $\phi 1$ rises to the H level, main internal power supply potential generating circuit 40 operates in the similar manner as in the case when the control signal is at the L level. Meanwhile, when control signal $\phi 1$ attains to the H level, N channel MOS transistor 428 in auxiliary internal power supply potential generating circuit 46 is rendered conductive, and differential amplifying circuit 422 starts its operation. Simultaneously, P channel MOS transistor 80 is rendered non-conductive.

When row address strobe signal ext/RAS attains to the L level, internal circuitry 1 is activated and starts its operation, At this time, as shown in FIG. 11(*e*), current of about 100 mA in average and several hundreds mA at most is consumed in internal circuitry 1. Therefore, the internal power supply potential intVcc lowers a little as shown in FIG. 11(*f*). Accordingly, the control potential $\phi 7$ output from differential amplifying circuit 422 in auxiliary internal power supply potential generating circuit 46 reaches immediately the potential extVcc—|Vtp| (for example, 4 V) which is lower than the power supply potential by the absolute value of the threshold voltage of transistor 421, as shown in FIG. 11(*c*), and in response, transistor 421 is rendered non-conductive. As a result, current is supplied from external power supply node 10 to the output node 50 through transistor 421.

At time t1, when the operation of the internal circuit 1 is completed, current consumption is reduced, and the internal power supply potential intVcc rises. Accordingly, the control signal $\phi$7 from differential amplifying circuit 422 in auxiliary internal power supply potential generating circuit 46 rises to a potential extVcc—|Vtp| which is lower than the external power supply potential by the absolute value of the threshold voltage of transistor 421 as shown in FIG. 11(*c*). Consequently, transistor 421 is rendered non-conductive, and supply of charges to the output node 50 is stopped.

Then, at time t2, when the row address strobe signal ext/RAS attains to the H level as shown in FIG. 11(*a*), reset current flows in the internal circuitry from time t2 to t3, as shown in FIG. 11(*e*). Here, the control signal $\phi$1 output from control circuit 30 is adapted to fall to L level at time t4 which is a prescribed time period after time t2 at which the row address strobe signal ext/RAS rises to the H level, as shown in FIG. 11(*b*), taking into account the reset current.

When the control signal $\phi$1 falls again to the L level at time t4, transistor 421 in differential amplifying circuit 422 is rendered non-conductive, and the differential amplifying circuit 422 stops its operation. At the same time, P channel MOS transistor 80 is rendered conductive, and therefore the gate of transistor 421 and the gate of transistor 401 are conducted. Consequently, as shown in FIG. 11(*c*), the control signal $\phi$7 applied to the gate of transistor 421 becomes equal to the control signal $\phi$8 applied to the gate of transistor 401.

In the internal power supply circuit in accordance with the fifth embodiment, while the control signal $\phi$1 is at the L level, that is, while the differential amplifying circuit 422 in the auxiliary internal power supply potential generating circuit 46 is not activated, the gate potential $\phi$8 of the transistor 401 in the main internal power supply potential generating circuit is applied to the gate of transistor 421 in the auxiliary internal power supply potential generating circuit 46, so that when control signal $\phi$1 attains to the H level, transistor 421 is immediately rendered conductive.

Therefore, as compared with the conventional internal power supply circuit in which internal power supply potential extVcc is applied to the gate of a transistor in the auxiliary internal power supply potential generating circuit at the standby state, a stable internal power supply potential intVcc can be constantly supplied by this internal power supply circuit.

Further, in the internal power supply circuit in accordance with the fifth embodiment, the absolute value |Vtp3| of the threshold voltage of transistor 401 can be easily made smaller than the absolute value |Vtp| of the threshold voltage of transistor 421 by, for example, making shorter the gate length of transistor 401 than the gate length of transistor 421.

Consequently, when internal circuitry 1 constantly consumes current at the standby state and the internal power supply potential intVcc does not match differ from the reference potential Vref, only the transistor 401 in main internal power supply generating circuit 40 is rendered conductive. Therefore, the transistor 421, which has large size, is hardly rendered conductive or non-conductive by the differential amplifying circuit 402 having small driving capability. Therefore, a stable internal power supply potential intVcc can be constantly supplied.

In the fifth embodiment, transistor 80 corresponds to the standby means which provides to the source and gate of transistor 421 a standby voltage |Vtp3| which is smaller than the absolute value |Vtp| of the threshold voltage of the transistor and larger than zero volt while differential amplifying circuit 421 is not activated.

[Embodiment 6]

Figure 12:
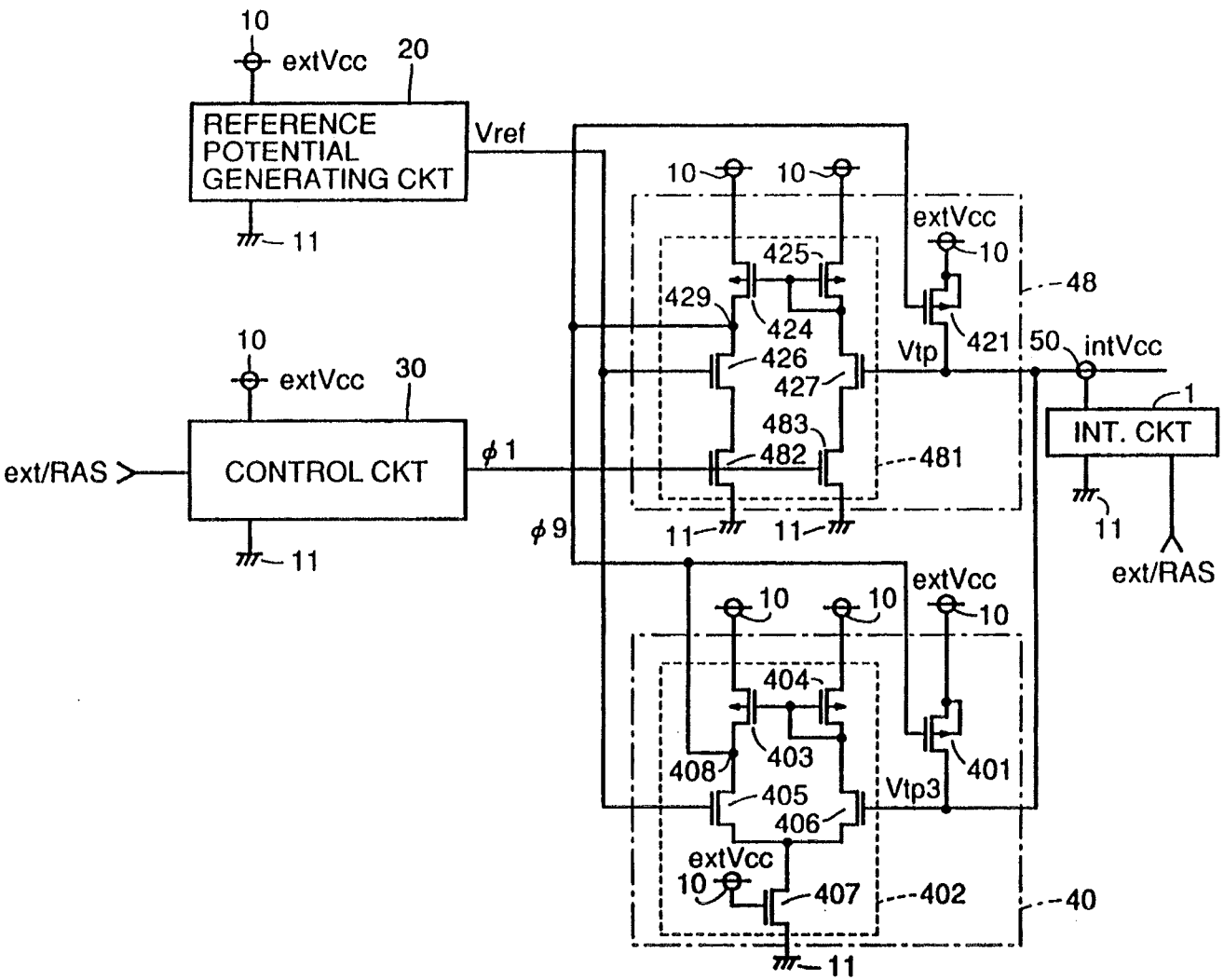
FIG. 12 is a block diagram showing the structure of the DRAM including the internal power supply circuit in accordance with the sixth embodiment of the present invention.

FIG. 12 is a block diagram showing the structure of the DRAM including the internal power supply circuit in accordance with the sixth embodiment of the present invention. The internal power supply circuit includes, similarly to the first embodiment, reference potential generating circuit 20, control circuit 30, main internal power supply potential generating circuit 40 and, in addition, an auxiliary internal power supply potential generating circuit 48 which is different from that of the first embodiment.

The internal power supply circuit in accordance with the sixth embodiment differs from the first embodiment described above in the following points. First, the auxiliary internal power supply potential generating circuit 48 is not provided with the standby potential supplying circuit 441. Second, the gate of transistor 401 in main internal power supply potential generating circuit 40 is directly connected to the gate of transistor 421 in auxiliary internal power supply potential generating circuit 48. Third, in place of transistor 428 in the first embodiment, two N channel MOS transistors 482 and 483 are provided in the differential amplifying circuit 481.

Transistor 482 is connected between the source of transistor 426 and the ground node 11, and receives at its gate the control signal 61. Transistor 483 is connected between the source of transistor 427 and the ground node 11, and receives at its gate the control signal Therefore, sources of transistors 426 and 427 are not commonly connected.

The operation of the internal power supply circuit will be described with reference to the timing chart of FIG. 13.

Figure 13:
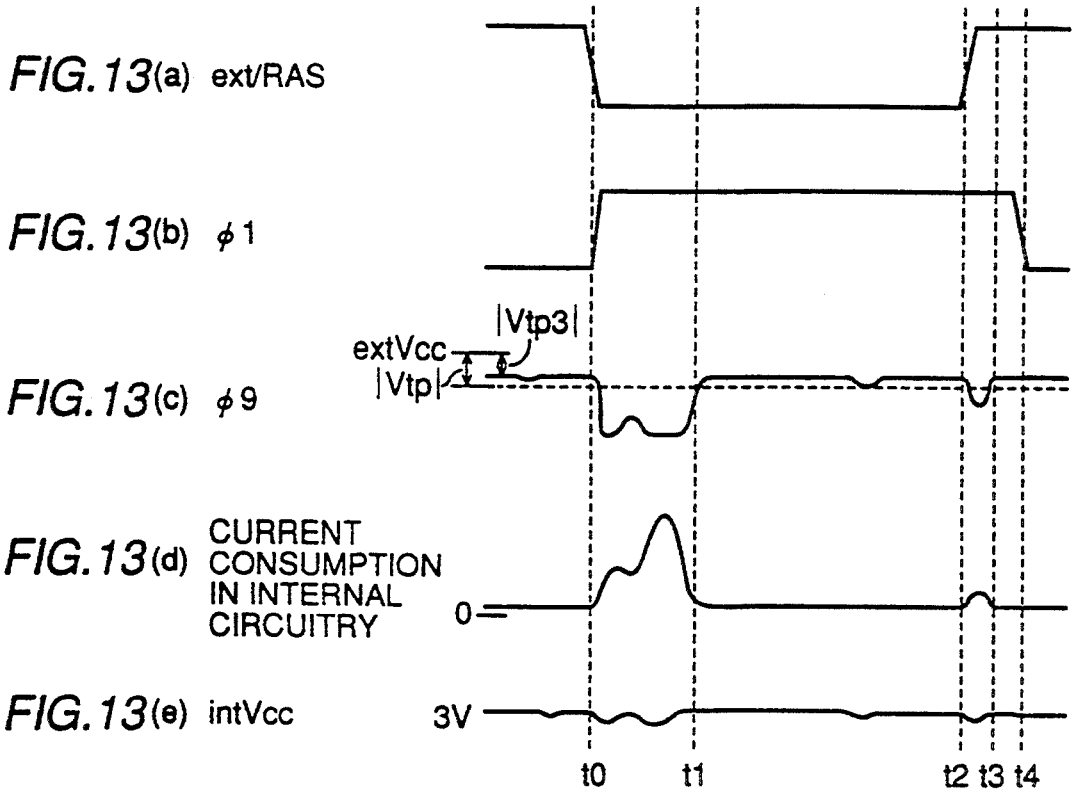
FIG. 13 is a timing chart showing the operation of the internal power supply circuit shown in FIG. 12.

First, as shown in FIG. 13(*a*), before time t0, when external row address strobe signal ext/RAS is at H level, the control signal $\phi$1 output from control circuit 30 attains to the L level, as shown in FIG. 13(*b*).

While the control signal $\phi$1 is at the L level, transistors 482 and 483 in differential amplifying circuit 481 are rendered non-conductive, and therefore the differential amplifying circuit 481 does not operate.

Consequently, the transistor 401 in main internal power supply potential generating circuit 40 and transistor 421 in auxiliary internal power supply potential generating circuit 48 are controlled only by the differential amplifying circuit 402 which has small driving capability.

Before time t0, internal circuitry 1 is at the standby state, and therefore it constantly consumes current. Here, referring to FIG. 13(*e*), when internal power supply potential intVcc lowers because of the constant current consumption, the differential amplifying circuit 402 applies a control potential $\phi$9 which is lower than a prescribed potential extVcc—|Vtp3| to the gate of transistor 401 in main internal power supply potential generating circuit 40 and to the gate of transistor 421 in the auxiliary internal power supply potential generating circuit 48, as shown in FIG. 13(*c*).

Consequently, transistor 401 in main internal power supply potential generating circuit 40 is immediately rendered conductive, and the internal power supply potential intVcc is immediately raised to the reference potential Vref. Accordingly, the control potential $\phi$9 rises quickly, and it rarely lowers to the potential extVcc—|Vtp| which is lower than the external power supply potential by the absolute value of the threshold voltage of transistor 421. Therefore, at the standby state, transistor 421 in auxiliary internal power supply potential generating circuit 48 is hardly rendered conductive.

Then, at time t0, when row address strobe signal ext/RAS attains to the L level as shown in FIG. 13(*a*), control signal $\phi$1 rises to the H level as shown in FIG. 13(*b*). The control signal $\phi$1 of the H level is applied to the gates of transistors 482 and 483 of the differential amplifying circuit 481, so that the differential amplifying circuit 481 is activated. Consequently, both the differential amplifying circuit 402 having smaller driving capability and the differential amplifying circuit 481 having larger driving capability apply the control potential $\phi$9 to the gates of transistors 401 and 421 so as to control transistors 401 and 421.

When control signal $\phi$1 attains to the H level, internal circuit 1 starts its operation, current consumption thereof is increased as shown in FIG. 13(*d*), and the internal power supply potential intVcc lowers as shown in FIG. 13(*e*). In response, differential amplifying circuits 402 and 481 lower the control potential $\phi$9 which is applied to the gates of transistor 401 and 421 as shown in FIG. 13(*c*), and in response, transistors 401 and 421 supply charges from external power supply node 10 to output node 50.

Then, referring to FIG. 13(*d*), at time t1, when current consumption in internal circuitry 1 is reduced and the internal power supply potential intVcc return to the reference potential Vref as shown in FIG. 13(*e*), in response, differential amplifying circuits 402 and 481 raises the control potential $\phi$9 to be applied to the gates of transistors 401 and 421 to the potential extVcc—Vtp3— which is lower than the external power supply potential by the absolute value of the threshold voltage of transistor 401, as shown in FIG. 13(*c*). Consequently, transistors 401 and 402 are both rendered non-conductive.

Then, at time t2, when external row address strobe signal ext/RAS attains to the H level as shown in FIG. 13(*a*), reset current flows in the internal circuitry 1, and power consumption thereof increases as shown in FIG. 13(*a*).

Referring to FIG. 13(*b*), control signal $\phi$1 is maintained at the H level from time t2 to t3, and therefore differential amplifying circuits 402 and 481 lower the control potential $\phi$9 which is applied to the gates of transistors 401 and 421, as shown in FIG. 13(*c*).

Consequently, both transistors 401 and 421 are rendered conductive, and therefore charges are supplied from external power supply node 10 to output node 50.

Then, at time t3, when internal power supply potential intVcc returns to the reference potential Vref as shown in FIG. 13(*e*), differential amplifying circuits 402 and 481 raise the control potential $\phi$9 applied to the gates of transistors 401 and 421 to a potential extVcc—|Vtp3| which is lower than the external power supply potential by the absolute value of the threshold voltage of transistor 401 as shown in FIG. 13(*c*) in response thereto.

In the internal power supply circuit in accordance with the sixth embodiment, the transistor 421 in auxiliary internal power supply potential generating circuit 48 is rendered conductive by the differential amplifying circuit 402 in the main internal power supply potential generating circuit 40 even when differential amplifying circuit 481 in auxiliary internal power supply potential generating circuit 48 is not activated. Therefore, when control signal $\phi$1 attains to the H level and differential amplifying circuit 481 starts its operation, charges can be immediately supplied to the output node 50 by transistor 421.

As in the fifth embodiment, by making shorter the channel length of transistor 401 than that of transistor 421, the absolute value |Vtp3| of the threshold voltage of transistor 401 can be readily made smaller than the absolute value |Vtp| of the threshold voltage of transistor 421.

Accordingly, when internal circuitry 1 consumes current constantly at the standby state and internal power supply potential intVcc does not match differ from the reference potential Vref, only the transistor 401 in main internal power supply potential generating circuit 40 is rendered conductive. Therefore, transistor 421 having larger size in auxiliary internal power supply potential generating circuit 48 is hardly rendered conductive or non-conductive only by the differential amplifying circuit 402 having small driving capability. Therefore, the internal power supply circuit can constantly supply a stable internal power supply potential intVcc.

Further, in the internal power supply circuit in accordance with the sixth embodiment, transistors 482 and 483 are connected to the sources of transistors 426 and 427, respectively, so that the current path from the external power supply node 10 to the ground node is completely separated.

Therefore, when the control signal $\phi$1 at the L level is applied to the gates of transistors 482 and 483 inactivating the differential amplifying circuit 482, the control potential $\phi$9 is not changed by the differential amplifying circuit 481. More specifically, even when control potential $\phi$9 output from differential amplifying circuit 402 in main internal power supply potential generating circuit 40 changes, the change is not transmitted to the drain node of transistor 425 through output node 429, and hence the potential $\phi$9 at the output node 429 does not change because of the current flowing in transistor 424.

[Embodiment 7]

Figure 14:
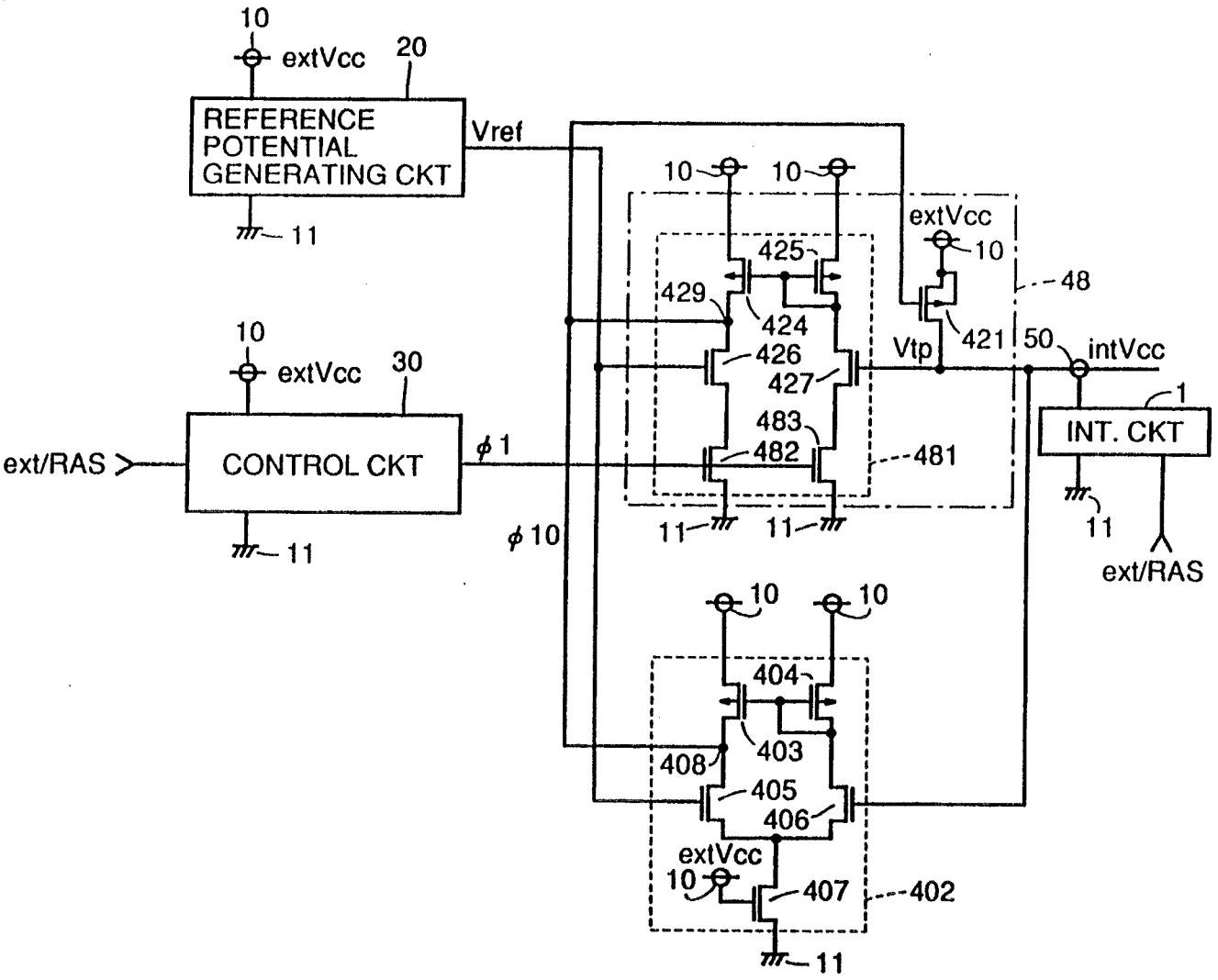
FIG. 14 is a block diagram showing the structure of the DRAM including the internal power supply circuit in accordance with the seventh embodiment of the present invention.

FIG. 14 is a block diagram showing a structure of the DRAM including the internal power supply circuit in accordance with the seventh embodiment of the present invention.

Referring to FIG. 14, the internal power supply circuit includes, as in the sixth embodiment, a reference potential generating circuit 20, a control circuit 30, an auxiliary internal power supply potential generating circuit 48, and a differential amplifying circuit 402 constituting a main internal power supply potential generating circuit. The internal power supply circuit does not include the P channel MOS transistor 401 of the main internal power supply potential generating circuit 40 of the sixth embodiment.

The operation of the internal power supply circuit will be described with the reference to the timing chart of FIG. 15.

Figure 15:
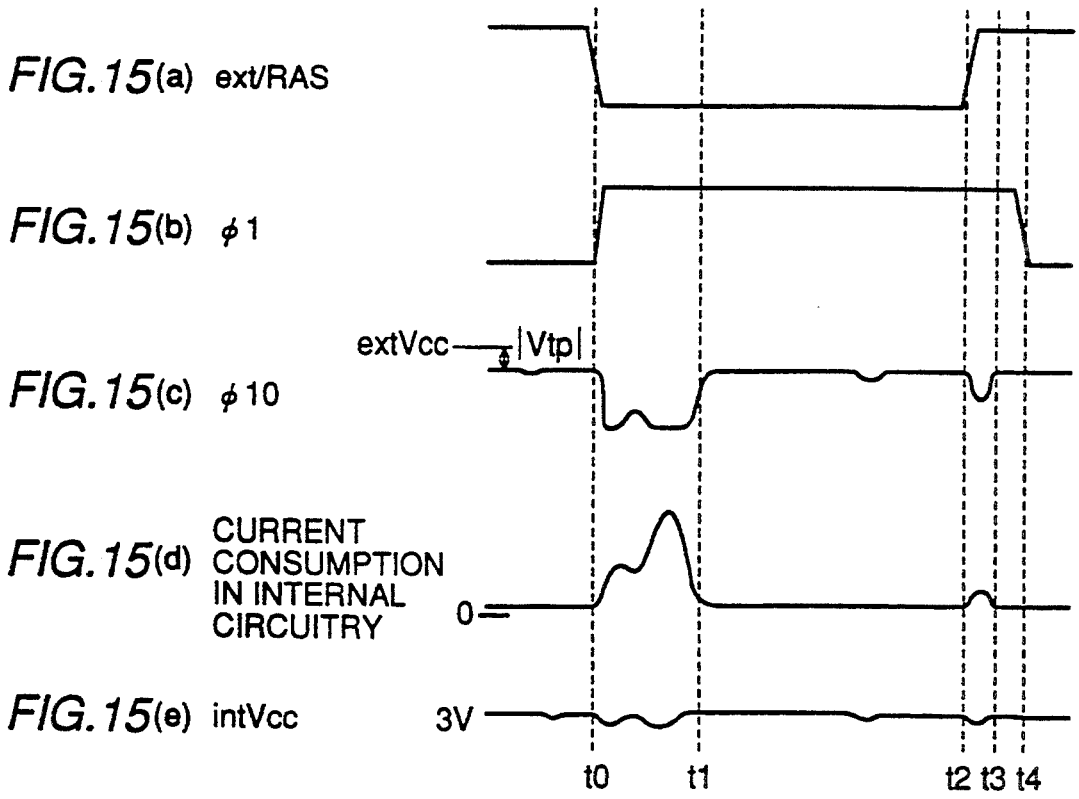
FIG. 15 is a timing chart showing the operation of the internal power supply circuit shown in FIG. 14.
Figure 16:
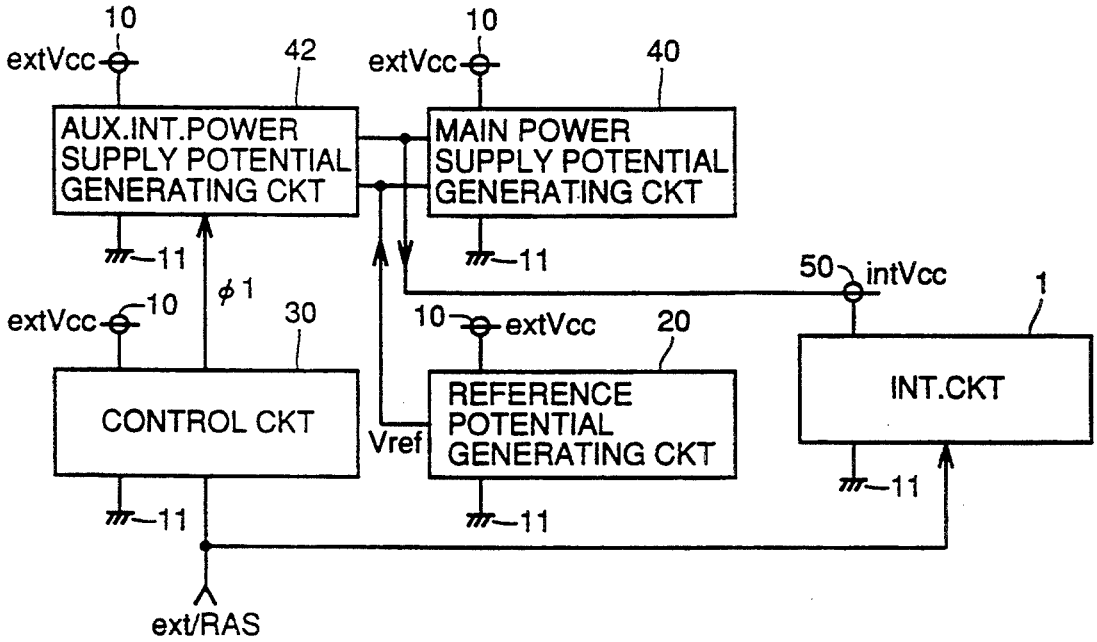
FIG. 16 PRIOR ART
FIG. 16 is a block diagram showing the structure of the DRAM including a conventional internal power supply circuit.

Referring to FIG. 13(*a*), before time t0, when external row address strobe signal ext/RAS is at the H level, control signal $\phi$1 is at the L level as shown in FIG. 15(*b*).

While the control signal $\phi$1 is at the L level, differential amplifying circuit 481 is not activated. Therefore, only differential amplifying circuit 402 having small driving capability (capability of charging/discharging the gate of transistor 421) and small power consumption controls the control potential $\phi$10 which is applied to the transistor 421.

At the standby state, internal circuitry 1 consumes only a small amount of current constantly, so that internal power supply potential intVcc does not change abruptly. Therefore, there is no problem even if the transistor 421 is controlled slowly by differential amplifying circuit 402 having small driving capability.

Then, referring to FIG. 15(*a*), when external row address strobe signal ext/RAS falls to the L level at time t0, control signal $\phi$1 rises to the H level as shown in FIG. 15(*b*).

When control signal $\phi$1 rises to the H level, differential amplifying circuit 481 starts its operation, and controls transistor 421 together with differential amplifying circuit 402 having small driving capability. At the same time, internal circuitry 1 starts its operation and when the current consumption increases as shown in FIG. 15(*d*), internal power supply potential intVcc lowers as shown in FIG. 15(*e*). In response, the control potential $\phi$1 output from differential amplifying circuits 402 and 481 becomes lower than the prescribed potential extVcc—|Vtp| as shown in FIG. 15(*c*), so that the transistor 421 is rendered conductive and charges are supplied to output node 50.

Then, at time t1, when current consumption in internal circuitry 1 returns to the normal value as shown in FIG. 15(*d*) and internal power supply potential intVcc returns to the reference potential Vref as shown in FIG. 15(*e*), control potential $\phi$10 output from differential amplifying circuits 402 and 481 rises to the prescribed potential extVcc—|Vtp|, as shown in FIG. 15(*c*). Consequently, transistor 421 is rendered non-conductive.

Then, at time t2, when external row address strobe signal ext/RAS attains to the H level as shown in FIG. 15(*a*), reset current flows in the internal circuitry as shown in FIG. 15(*a*).

Since control signal $\phi$1 is kept at the H level from time t2 to t4 as shown in FIG. 15(*b*), differential amplifying circuit 481 having large driving capability is still activated.

Therefore, when internal power supply potential intvcc lowers as shown in FIG. 15(*e*), control potential $\phi$10 output from differential amplifying circuits 402 and 481 becomes lower than the prescribed potential extVcc—|Vtp| as shown in FIG. 15(*c*). Consequently, transistor 421 is rendered conductive, and charges are supplied to output node 50.

Then, when internal power supply potential intVcc returns to the reference potential Vref at time t3, as shown in FIG. 15(*e*), control potential $\phi$10 rises to the prescribed potential extVcc—|Vtp| as shown in FIG. 15(*c*). Consequently, transistor 421 is rendered non-conductive.

In the internal power supply circuit in accordance with the seventh embodiment, the control potential output from differential amplifying circuit 402 in main internal power supply potential generating circuit is applied to the gate of transistor 421, even when differential amplifying circuit 481 in auxiliary internal power supply potential generating circuit 48 is not activated. Since this transistor 421 is rendered conductive, when differential amplifying circuit 481 in auxiliary internal power supply potential generating circuit 48 is activated, charges can be immediately supplied to output node 50 by the transistor 421.

As in the sixth embodiment, in the internal power supply circuit of the seventh embodiment, sources of transistors 426 and 427 in differential amplifying circuit 481 are separated. Therefore, when control potential $\phi$10 output from differential amplifying circuit 402 changes while the differential amplifying circuit 481 is not activated, the change is not transmitted to the drain of transistor 425 through output node 429, and hence the control potential $\phi$10 does not change because of the current flowing in transistor 424.

Further, since only one driving transistor 421 is provided in the internal power supply circuit, the area necessary for the layout can be made smaller than the sixth embodiment which includes two driving transistors.

[Additional Embodiment]

In the first embodiment described above, the absolute value |Vtp1| of the threshold voltage P channel MOS transistor 442 in standby potential supplying circuit 441 is made smaller than the absolute value |Vtp| of transistor 421 by making shorter the channel length L1 than the channel length L2 of transistor 421. However, the absolute value |Vtp1| of the threshold voltage of transistor 422 maybe made smaller than the absolute value |Vtp| of the threshold voltage of transistor 421 by implanting ions to the semiconductor surface below the gate oxide film of transistor 421, or by forming transistors 442 and 421 in different wells and making lower the backgate potential of transistor 442 than that of transistor 421.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An internal power supply circuit for generating an internal power supply potential by lowering an external power supply potential, comprising:

(a) an output node at which said internal power supply potential is generated;

(b) main internal power supply potential generating means for constantly generating said internal power supply potential at said output node based on a constant reference potential from a constant reference potential source; and (c) auxiliary internal power supply potential generating means including switching means connected between an external power supply node to which said external power supply potential is applied and said output node for conducting said external power supply node and said output node when a voltage larger than a prescribed threshold voltage is applied, comparing means activated temporarily in response to a prescribed control signal and when activated, for comparing a potential, generated at said output node and changing in response to said internal power supply potential, with said reference potential, for applying a control voltage larger than said threshold voltage to said switching means in a first case in which said potential is lower than said reference potential, and for applying a control voltage smaller than said threshold voltage to said switching means in a second case in which said potential is higher than said reference potential, and standby means for applying a standby voltage which is smaller than said threshold voltage but larger than zero voltage to said switching means while said comparing means is not activated.

2. The internal power supply circuit according to claim 1, wherein said switching means includes a P channel MOS transistor having its source connected to said external power supply node and its drain connected to said output node;

said comparing means includes means for applying said control voltage between said source and a gate of said P channel MOS transistor; and said standby means includes means for applying said standby voltage between said source and said gate of said P channel MOS transistor.

3. An internal power supply circuit for generating an internal power supply potential by lowering an external power supply potential, comprising:

(a) an output node at which said internal power supply potential is generated;

(b) main internal power supply potential generating means for constantly generating said internal power supply potential at said output node based on a constant reference potential from a constant reference potential source; and (c) auxiliary internal power supply potential generating means including a first P channel MOS transistor having its source connected to an external power supply node to which said external power supply potential is applied, and its drain connected to said output node, auxiliary comparing means temporarily activated in response to a prescribed control signal and when activated, for comparing a potential, generated at said output node and changing in response to said internal power supply potential, with said reference potential, for applying to a gate of said first P channel MOS transistor a first control potential lower than a first threshold potential which is lower than said external power supply potential by an absolute value of a threshold voltage of said first P channel transistor in a first case in which said potential is lower than said reference potential, and for applying a first control potential higher than said first threshold potential to said gate of said first P channel MOS transistor in a second case in which said potential is higher than said reference potential, and standby means for applying a standby potential which is lower than said external power supply potential but higher than said first threshold potential to said gate of said first P channel MOS transistor.

4. The internal power supply circuit according to claim 3, wherein said standby means includes voltage lowering means for generating said standby potential by lowering said external power supply potential, and transmitting means for transmitting said standby potential generated by said voltage lowering means to said gate of said first P channel MOS transistor while said auxiliary comparing means is not activated.

5. The internal power supply circuit according to claim 4, wherein said voltage lowering means includes a second P channel MOS transistor having its source connected to said external power supply node and its drain and gate connected to each other, and having a threshold voltage of which absolute value is smaller than the absolute value of said threshold voltage of said first P channel MOS transistor.

6. The internal power supply circuit according to claim 5, wherein said transmitting means includes a third P channel MOS transistor having its source connected to said drain and said gate of said second P channel MOS transistor, its drain connected to said gate of said first P channel MOS transistor, and its gate receiving an activating signal which is at a low level while said auxiliary comparing means is not activated.

7. The internal power supply circuit according to claim 5, wherein channel length of said second P channel MOS transistor is made shorter than that of said first P channel MOS transistor.

8. The internal power supply circuit according to claim 5, wherein backgate potential of said second P channel MOS transistor is set lower than that of said first P channel MOS transistor.

9. The internal power supply circuit according to claim 6, wherein said main internal power supply potential generating means includes a fourth P channel MOS transistor having its source connected to said external power supply node, and its drain connected to said output node, and main comparing means for comparing said potential with said reference potential for applying to a gate of said fourth P channel MOS transistor a second control potential lower than a second threshold potential which is lower than said external power supply potential by an absolute value of a threshold voltage of said fourth P channel MOS transistor in said first case, and for applying a second control potential higher than said second threshold potential to said gate of said fourth P channel transistor in said second case.

10. The internal power supply circuit according to claim 9, wherein said auxiliary comparing means includes:

a fifth P channel MOS transistor having its source connected to said external power supply node, and its drain connected to said gate of said first P channel MOS transistor;

a sixth P channel MOS transistor having its source connected to said external power supply node, and its drain and gate connected to each other and to a gate of said fifth P channel MOS transistor;

a first N channel MOS transistor having its drain connected to said drain of said fifth P channel MOS transistor, and its gate receiving said reference potential;

a second N channel MOS transistor having its drain connected to said drain and said gate of said sixth P channel MOS transistor, its source connected to said source of said first N channel MOS transistor, and its gate connected to said output node;

a third N channel MOS transistor having its drain connected to said sources of said first and second N channel MOS transistors, respectively, and its source connected to a ground node; and temporarily activating means responsive to said control signal for temporarily applying a potential sufficient to set said third P channel MOS transistor to a saturated state, to said gate of said third P channel MOS transistor.

11. The internal power supply circuit according to claim 10, wherein said main comparing means includes:

a seventh P channel MOS transistor having its source connected to said external power supply node, and its drain connected to said gate of said fourth P channel MOS transistor;

an eighth P channel MOS transistor having its source connected to said external power supply node, and its drain and its gate connected to each other and to a gate of said seventh P channel MOS transistor;

a fourth N channel MOS transistor having its drain connected to said drain of said seventh P channel MOS transistor, and its gate receiving said reference potential;

a fifth N channel MOS transistor having its drain connected to said drain and said gate of said eighth P channel MOS transistor, its source connected to a source of said fourth N channel MOS transistor, and its gate connected to said output node;

a sixth N channel MOS transistor having its drain connected to said sources of said fourth and fifth N channel MOS transistors, respectively, and its source connected to said ground node; and constant activating means for constantly applying a potential sufficient to set said sixth N channel MOS transistor to a saturated state to a gate of said sixth N channel MOS transistor.

12. The internal power supply circuit according to claim 11, wherein said temporary activating means includes means for applying a potential sufficient to set said third P channel MOS transistor to a saturated state but lower than said internal power supply potential to said gate of said third P channel MOS transistor in response to said control signal; and said constant activating means includes means for applying said reference potential which is sufficient to set said sixth N channel MOS transistor to the saturated state.

13. An internal power supply circuit for generating an internal power supply potential by lowering an external power supply potential, comprising:

(a) an output node at which said internal power supply potential is generated;

(b) a first P channel MOS transistor having its source connected to an external power supply node to which said external power supply potential is applied, and its drain connected to said output node;

(c) main comparing means which is constantly activated for comparing a potential, generated at said output node and changing in response to said internal power supply potential, with a constant reference potential from a constant reference potential source, for applying to a gate of said first P channel MOS transistor a control potential lower than a threshold potential which is lower than said external power supply potential by an absolute value of a threshold voltage of said first P channel transistor in a first case in which said potential is lower than said reference potential, and for applying a control potential higher than said threshold potential to said gate of said first P channel MOS transistor in a second case in which said potential is higher than said reference potential; and (d) auxiliary comparing means activated temporarily in response to a prescribed control signal and when activated, for comparing said potential with said reference potential, for applying said control potential lower than said threshold potential to said gate of said first P channel MOS transistor in said first case, and for applying said control potential higher than said threshold potential to said gate of first P channel MOS transistor in said second case.

14. The internal power supply circuit according to claim 13, further comprising:

a second P channel MOS transistor having its source connected to said external power supply node, its drain connected to said output node, and its gate receiving said control potential.

15. The internal power supply circuit according to claim 14, further comprising:

a third P channel MOS transistor having its source/drain connected to said gate of said first P channel MOS transistor,, its drain/source connected to said gate of said second P channel MOS transistor, and its gate receiving an activating signal which is at a low level while said auxiliary comparing means is not activated; wherein said main comparing means applies said control potential to said gate of said first P channel MOS transistor through said third P channel MOS transistor only while said auxiliary comparing means is not activated, and applies said control potential constantly to said gate of said second P channel MOS transistor.

16. The internal power supply circuit according to claim 15, wherein absolute value of the threshold voltage of said first P channel MOS transistor is made larger than that of said second P channel MOS transistor.

* * * * *